US005947600A

United States Patent [19]

Maeda et al.

[11] Patent Number: 5,947,600

[45] Date of Patent: Sep. 7, 1999

[54] STATIC MIXING METHOD

[75] Inventors: Matabee Maeda; Kazuie Yamada; Akira Uchida; Masaaki Miyata; Shinichi Igawa; Hideto Karasawa, all of Tokyo, Japan

[73] Assignee: Maeda Corp., Tokyo, Japan

[21] Appl. No.: 08/820,959

[22] Filed: Mar. 19, 1997

[30] Foreign Application Priority Data

| | | | |
|---|---|---|---|
| Mar. 20, 1996 | [JP] | Japan | 8-091980 |
| Mar. 31, 1996 | [JP] | Japan | 8-101957 |
| Apr. 16, 1996 | [JP] | Japan | 8-118329 |

[51] Int. Cl.[6] ..... B01F 5/06

[52] U.S. Cl. ..... 366/337; 366/336

[58] Field of Search ..... 138/39, 42; 366/77, 366/91, 96, 134, 336, 337, 341, 338, 339, 340, 160.1, 160.2, 174.1, 175.1

[56] References Cited

U.S. PATENT DOCUMENTS

| | | | |
|---|---|---|---|
| 3,317,191 | 5/1967 | Brown et al. | 366/341 X |
| 3,963,221 | 6/1976 | Yi | 366/341 |
| 3,977,657 | 8/1976 | Shearer et al. . | |
| 4,618,294 | 10/1986 | Brown | 366/338 X |
| 5,492,409 | 2/1996 | Karlsson et al. | 366/338 X |

FOREIGN PATENT DOCUMENTS

| | | |
|---|---|---|
| 2508482 | 1/1976 | Germany . |
| 3026039 | 1/1982 | Germany . |
| 61-000607 | 1/1986 | Japan . |

*Primary Examiner*—W. L. Walker
*Assistant Examiner*—Terry C. Cecil
*Attorney, Agent, or Firm*—Greer, Burns & Crain, Ltd.

[57] ABSTRACT

A static mixing method for running a material through an element having at least two irregular passageways. Irregular passageways have an inlet, an outlet and a continuously varying sectional configuration from inlet to outlet. The mixed materials have a fluidity and are fed by pressurization into the apparatus. The mixed materials are compacted and reshaped by the sectional configurations.

7 Claims, 26 Drawing Sheets

STATIC MIXING METHOD

BACKGROUND OF THE INVENTION

1. Field of the Invention

The present invention relates to a mixing method of a and a mixing apparatus for a mixing fluid materials to be mixed and, more particularly, to a mixing method and a mixing apparatus for mixing the mixed materials while changing sectional configurations of the mixed materials themselves by running the mixed materials through irregular passageways with varied sectional shapes.

2. Description of the Related Art

A variety of materials need to be kneaded or mixed. Those materials are used for noodles like, e.g., "thick white noodles" and "buckwheat noodles" as favored foods, and others are materials for kneaded products, and further, mortar and concrete, etc.

The mixed materials requiring mixing exhibit more favored or preferable characteristics as they are more mixed in many cases. Accordingly, in the case of such mixed materials, a sufficient mixing operation is needed before use.

The prior art mixing methods entail mixers (mixing apparatuses) classified as a bowl type, a shell type and a roll type, depending on their mixing system. Those mixing methods are mechanically carried out and therefore suitable for mixing a good deal of materials. However, the above-described prior art mixing apparatuses are effective depending on the materials to be mixed and are known to be inefficient in terms of energy and time that are needed for mixing.

According to, for instance, "Synthesization of Mixing Systems and Optimum Layer Formation" {Powder Engineering Association Report Vol. 19, No. 11 (1982)}, a study report by Yoji Akao, Hisakazu Shindo and Anhel Ernan, a supply layer (optimum layer) reaches a complete mixed state the fastest when a layered mixed substance is obtained by folding a basic model of moving mixture, i.e., the layered mixed substance is acquired by repeating an operation of halving the material by compaction and superposing the half thereon.

In this respect, it can be understood that a classic kneading method of, e.g., as in the case of homemade bread, compacting, stretching, folding, layering, further compacting and stretching a kneading material, is quite efficient. Supposing that the folding and compacting step is performed 30 times, this is equivalent to approximately one-billion (the 30th power of 2) kneading operations. herein, if there is executed the mixing method of effecting the compaction in a state where the material is folded in 3 or 4 layers before being compacted, it can be imagined that the efficiency is further enhanced, wherein the numerical value corresponding to the 30th power of 2 in the above example becomes the 30th power of 3 or 4.

On the other hand, as described above, in the case of the known mixers (mixing apparatuses) of the bowl type, shell type and roll type, they have many mechanically movable portions, and therefore, often cause abrasions and damage. Moreover, the known apparatus itself is comparatively expensive. This point is obvious, wherein the mixed material is mortar and concrete containing particles of fine and coarse aggregates especially in the field of architecture and construction.

SUMMARY OF THE INVENTION

It is a primary object of the present invention to provide a mixing method and a mixing apparatus for mechanically performing such an efficient mixing operation as to compact, stretch, fold, layer, further compact and stretch materials to be mixed.

It is another object of the present invention to provide a mixing method and a mixing apparatus for compacting and stretching materials to be mixed by reshaping sectional shape of passageways themselves while letting the mixed materials through the passageways.

It is still another object of the present invention to provide a mixing method and a mixing apparatus for mixing materials to be mixed by reshaping sectional shapes of a plurality of passageways while letting the mixed materials through the passageways and, at the same time, changing an arrangement of inlets and outlets of these passageways.

It is yet another object of the present invention to provide a mixing apparatus capable of preventing abrasions and damages by eliminating direct movable portions.

It is a further object of the present invention to provide a mixing method and a mixing apparatus capable of further enhancing a mixing efficiency by reshaping sectional shapes of a plurality of passageways while letting the mixed materials through the passageways, thereby compacting and stretching the mixed materials, and mixing the mixed materials by controlling the timing for confluence of the mixed materials flowing through the respective passageways.

It is a still further object of the present invention to apply, for concrete placement, a mixing apparatus for compacting and stretching materials to be mixed by reshaping sectional shapes of a plurality of passageways while letting the mixed materials through the passageways.

To obviate the above-described technical problems, a method of mixing mixed materials having a fluidity by letting the mixed materials through irregular passageways with variations in their sectional configuration, comprises a step of continuously varying the sectional configurations of the irregular passageways from inlets thereof toward outlets thereof, a step of feeding the mixed materials by pressurization into the inlets of the regular passageways, a step of thereby continuously changing the sectional configurations of the mixed materials corresponding to the sectional shapes of the irregular passageways, and a step of mixing the mixed materials by compacting action and reshaping action based thereon to the mixed materials.

According to this mixing method of the present invention, it is preferable that the mixed materials flowing through the irregular passageways are made confluent and diverged between the inlets and the outlets of the irregular passageways. Then, further, timings when the mixed materials flowing through the respective irregular passageways get confluent, are staggered, and the confluence can be thus controlled.

In this case, the confluence is controlled by a method of changing lengths of the irregular passageways themselves, or by a method of changing the substantial lengths of the irregular passageways by providing bypasses.

Moreover, a part of material to be mixed in the above mixed materials is fed by pressurization into at least one of the irregular passageways midways of the irregular passageway. Note that the mixing method according to the present invention can be used when placing the concrete.

Furthermore, to obviate the above-described technical problems, a mixing apparatus according to the present invention is constructed as follows. That is, the mixing apparatus of the present invention mixes materials having a fluidity. This mixing apparatus comprises an apparatus body including a plurality of irregular passageways with their sectional configurations gradually varying in longitudinal directions, and a material force-feeding unit, connected to an inlet side of the apparatus body, for feeding the mixed materials by pressurization into the respective irregular passageways. Inlets of the irregular passageways are formed with a certain arrangement pattern at an inlet-side edge portion of the apparatus body. Also, outlets of the irregular passageways are formed with another arrangement pattern different from the arrangement pattern of the inlets, at an outlet-side edge portion of the apparatus body.

Moreover, a mixing apparatus according to the present invention further comprises a confluence control unit for staggering confluent timings of the mixed material flowing through at least one irregular passageway and of the mixed materials flowing through the other irregular passageways. This confluence control unit may be constructed by changing lengths of the irregular passageways themselves. Further, the confluence control unit is preferably constructed by changing substantial lengths of the irregular passageways by providing bypasses.

Moreover, in the mixing apparatus according to the present invention, at least one confluent/diverging unit for making confluent and diverging the mixed materials flowing through the irregular passageways is provided between the inlet-side edge portion and the outlet-side edge portion of the apparatus body.

Further, in the mixing apparatus according to the present invention, the apparatus body consists of a plurality of elements connected in series in the directions of the irregular passageways. The irregular passageways provided within the elements are formed of a multiplicity of partition walls. Inlets of the irregular passageways are formed with a certain arrangement pattern at the inlet-side edge portions of the respective elements. Outlets of the irregular passageways are formed with another arrangement pattern different from the arrangement pattern of the inlets, at the outlet-side edge portion thereof. The respective irregular passageways are formed so that sectional configurations thereof are gradually reshaped during shifts from the inlets to the outlets.

Still further, in the mixing apparatus according to the present invention, when the apparatus body is constructed by connecting the plurality of elements in series as explained above, the confluent/diverging unit is each of the inlets of the plurality of irregular passageways arranged at the inlet-side edge portion of the element disposed downstream and connected to the element disposed upstream.

Additionally, in the mixing apparatus according to the present invention, when the plurality of the irregular passageways are formed of partition walls within the element, the inlets of the irregular passageways are each formed in a square shape, and the outlets of the irregular passageways are formed in at least one line and in a side-by-side relationship lengthwise to each assume a rectangular shape.

Moreover, in the mixing apparatus according to the present invention, when the plurality of irregular passageways are formed of a multiplicity of partition walls within the element, the inlets of the irregular passageways are each formed in a lengthwise elongate rectangular shape, and the outlets of the irregular passageways are formed in at least one line and in a side-by-side relationship lengthwise to each assume a crosswise elongate rectangular shape.

Furthermore, in the mixing apparatus according to the present invention, a part of material to be mixed in the above mixed materials can be fed by pressurization into at least one of said irregular passageways midways of the irregular passageway.

Also, the mixing apparatus according to the present invention is used for placing the concrete, the material pressurizing unit feeds the concrete by pressurization into the respective irregular passageways of the apparatus body, and the concrete can be mixed in the apparatus body, thereafter discharged therefrom and then placed.

In addition, for the mixing apparatus employed for placing concrete according to the present invention, the apparatus body has its inlet-side edge portion detachably connected via a connecting member to a front edge portion of a force-feeding path.

Herein, flanges for connecting the elements adjacent to each other can be provided along edge portion outer peripheries of the respective elements constituting the apparatus body, and connecting edge portions of the individual elements are closely fitted and but-joined to each other.

BRIEF DESCRIPTION OF THE DRAWINGS

Other objects and advantages of the present invention will become apparent during the following discussion in conjunction with the accompanying drawings, in which.

DESCRIPTION OF THE PREFERRED EMBODIMENTS

Figure 1:
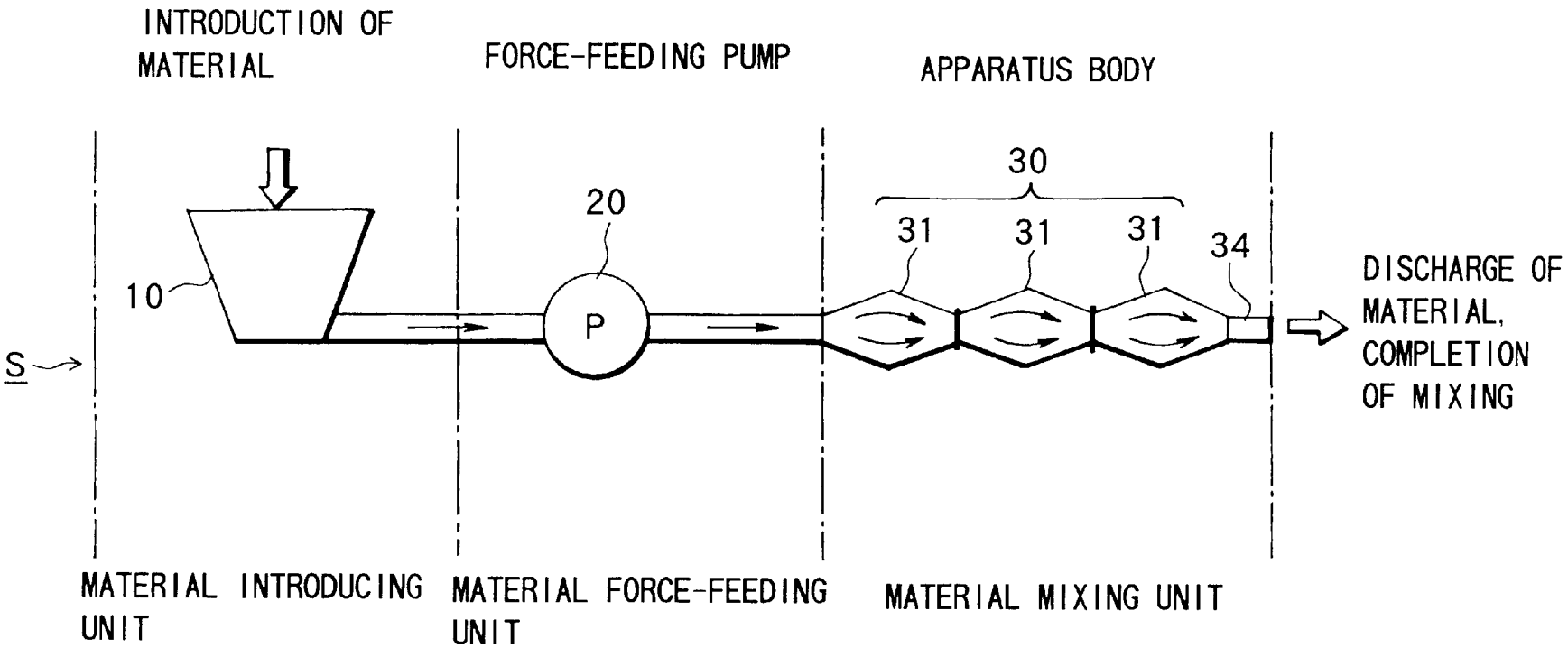
FIG. 1 is a diagram showing an outline of the parts in a mixing apparatus in accordance with a first embodiment of the present invention.
Figure 2:
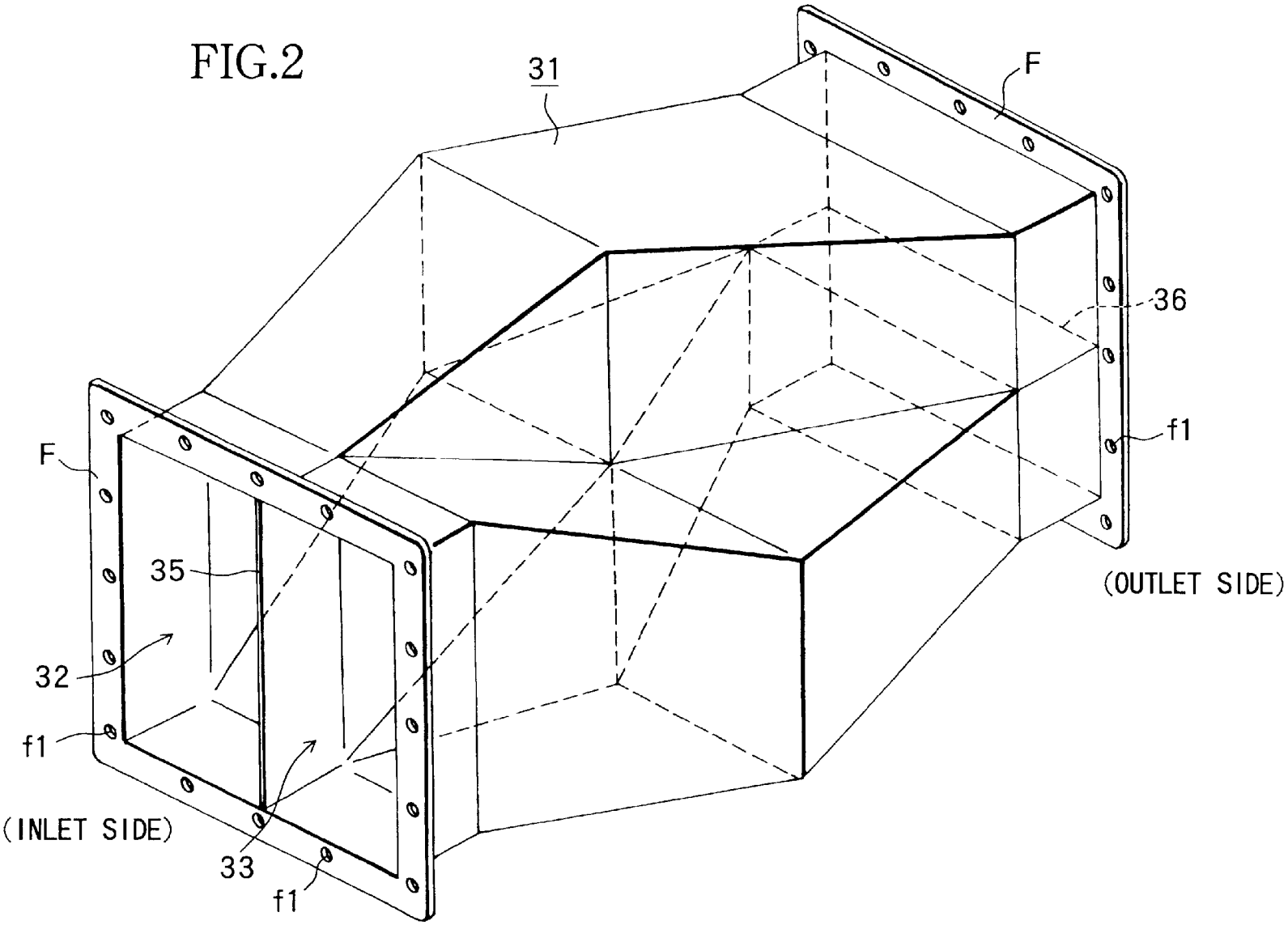
FIG. 2 is a perspective view illustrating one element partly constituting an apparatus body of a mixing apparatus shown in FIG. 1.
Figure 3:
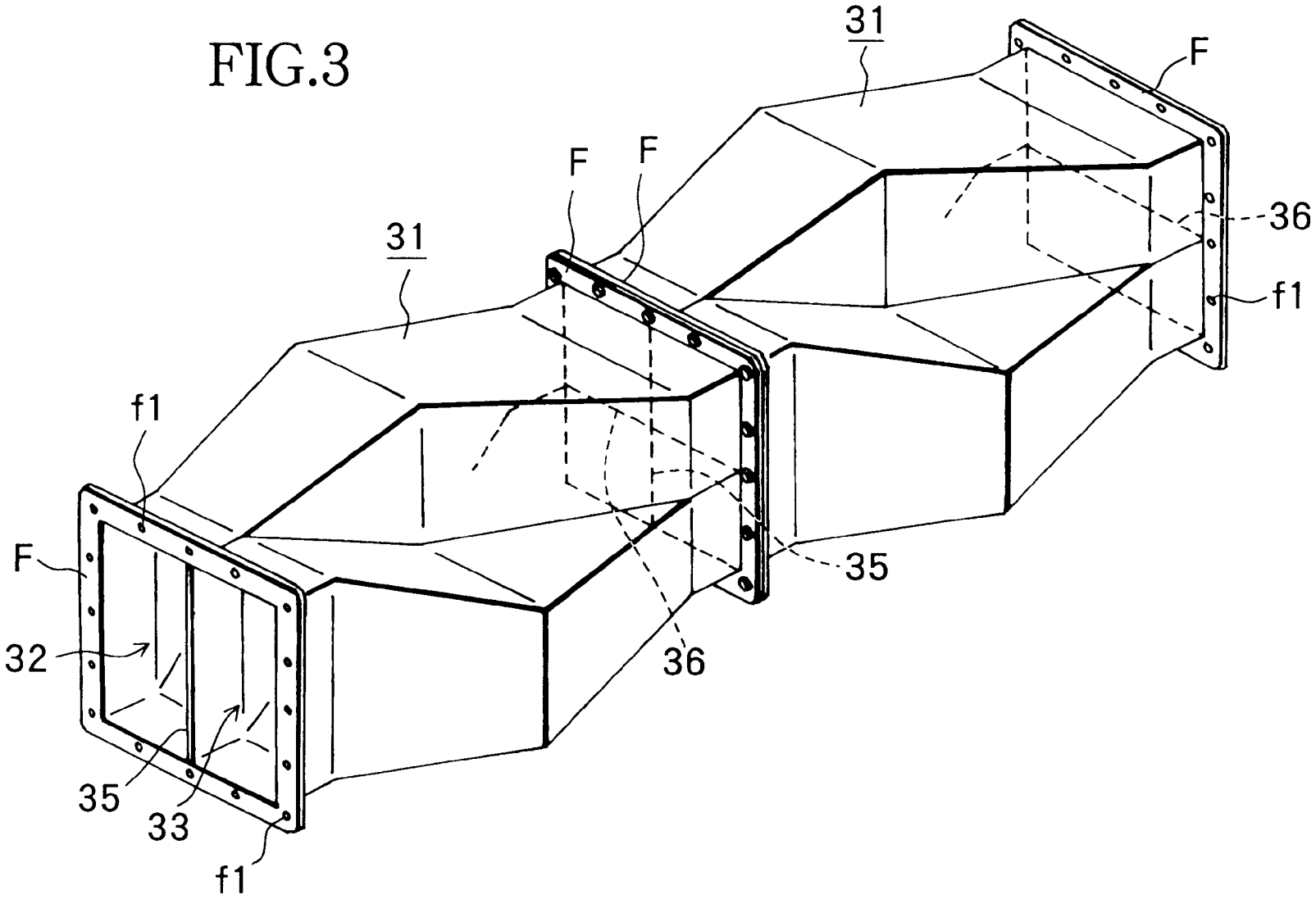
FIG. 3 is a perspective view illustrating a state where two elements shown in FIG. 2 are connected in series.

FIG. 1 is a view illustrating an outline of the parts in a mixing apparatus S in accordance with a first embodiment of the present invention. FIG. 2 is a perspective view showing one element partly constituting an apparatus body of this mixing apparatus S. FIG. 3 is a perspective view illustrating a state where two elements are connected to each other.

To start with, the diagram of the parts in the mixing apparatus S in the first embodiment shown in FIG. 1 will be described. This mixing apparatus S is basically constructed of a material introducing unit, a material force-feeding unit, and a material mixing unit. The material introducing unit consisting of a hopper 10 provides an initial mix, when mixed materials are, e.g., concrete and mortar, and holds the materials prepared at an adequate fluidity. The material introducing unit then supplies the material force-feeding unit with those materials. The material force-feeding unit, consisting of a pump 20 for force-feeding, e.g., the concrete, feeds the mixed materials to the material mixing unit (an apparatus body 30) by pressurization.

The apparatus body 30 defined as this material mixing unit is constructed of three pieces of elements 31 each having the same configuration and connected in series. Then, the mixed materials consecutively pass through the respective elements 31 of the apparatus body 30 and are thereby mixed, and discharged from a discharge port 34.

Flanges F for connecting the elements 31 to each other are, as illustrated in FIGS. 2 and 3, provided at edges of the respective elements 31. These elements 31 are connected in series by fastening the flanges F to each other by tightening bolts into a plurality of bolt holes f1 formed in the flanges F.

Each element 31 includes two irregular passageways 32, 33 disposed in a side-by-side relationship in the same direction. As illustrated in FIG. 3, the edge portion of one element 31, which portion is formed with outlets of the irregular passageways 32, 33, is connected to the edge portion of the other element 31 that is formed with inlets. Then, a confluent/diverging unit for the mixed materials at an intermediate portion within the apparatus body consists of the outlets and inlets of the respective irregular passageways, which are formed at the outlet-side edge portion and the inlet-side edge portion that serve as the connecting portion between the two elements 31.

More specifically, referring to FIG. 2, as viewed from the edge surface of the element 31, square bores at one edge portion and the other edge portion of the element 31, are formed with two inlets and two outlets each partitioned by partition walls 35, 36 at their centers. However, the partition wall 35 at the inlet-side edge portion of the element and the partition wall 36 at the outlet-side edge portion of the element, are disposed in different directions so that they are positioned at an angle 90 degrees apart from each other.

Accordingly, an arrangement pattern of the two inlets of the irregular passageways 32, 33 is such that the rectangular bores are formed right and left in the side-by-side relationship, while an arrangement pattern of the two outlets thereof is that the rectangular bores are formed up and down in the side-by-side relationship. A required number of such elements 31 are so employed as to be connected in series, and it follows that the confluent/diverging unit for the mixed materials is constituted at each connecting portion.

Next, specific configurations of the irregular passageways 32, 33 will be described. A sectional configuration of each of the irregular passageways 32, 33 continuously varies as it extends from the inlet toward the outlet. In terms of a variation form thereof, a sectional area in an arbitrary position remains the same at the inlet through the outlet, and only the sectional configuration continuously varies. To be specific, the inlet assumes a lengthwise elongate rectangular shape; the intermediate portion between the inlet and the outlet takes a square shape in its sectional configuration; and the outlet assumes a crosswise elongate rectangular shape. Then, lengths of the irregular passageways 32, 33 are equal to each other.

Hence, the mixed materials passing through the respective irregular passageways 32, 33 are varied in their sectional configurations so that the lengthwise elongate rectangle is gradually reshaped into the square and further reshaped little by little therefrom into the crosswise elongate rectangle. Then, as stated above, the outlets are disposed at the outlet-side edge portion with such a pattern that the two crosswise elongate rectangles are arranged up and down in the side-by-side relationship. It therefore follows that the mixed materials coming out of the outlet-side edge portion of the element 31 are further equally halved right and left at the inlet-side edge portion of the next element 31 subsequent thereto. These varied states of the mixed materials correspond to the confluence and divergence connoted according to the present invention.

Figure 4:
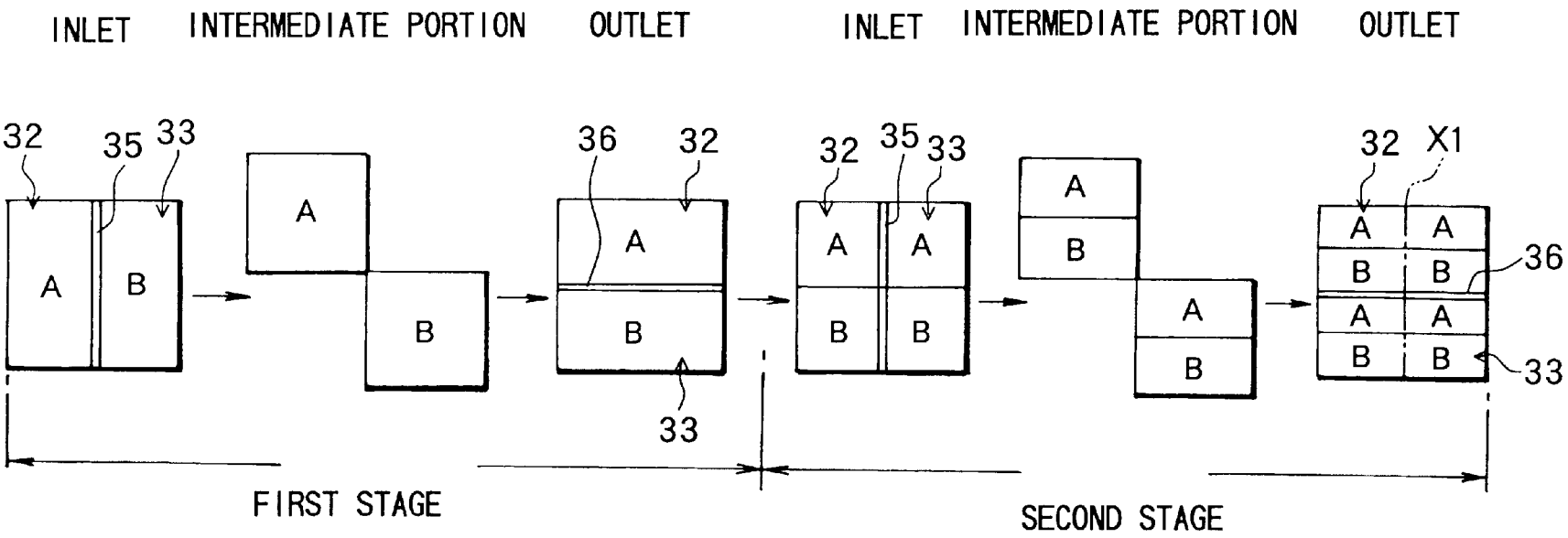
FIG. 4 is a step diagram showing a mixing step modelwise by use of the mixing apparatus in the first embodiment.

A mixing method using the mixing apparatus S in the first embodiment discussed above, will be herein explained with reference to FIG. 4 showing steps of this method. Note that this step diagram shows modelwise the sectional varied forms of the mixed materials when two pieces (two stages) of elements 31 are connected, with respect to areas of the inlet-side edge portion, the intermediate portion and the outlet-side edge portion of the respective elements 31.

As can be clearly understood from FIG. 4, to begin with, the mixed materials force-fed in by the force-feeding pump 20 are diverged into A and B at the inlet-side edge portion by the first-stage element 31. Each of the sectional configurations of the thus diverged mixed materials is the lengthwise elongate rectangle.

Next, at the first-stage intermediate portion, each mass of the mixed materials A, B is reshaped in sectional configuration into the square and further, at the first-stage outlet-side edge portion, reshaped into the crosswise elongate rectangle. Accordingly, each sectional configuration of the mixed materials A, B changes like this: lengthwise elongate rectangle→square→crosswise elongate rectangle. In the process of these variations, the mixed materials undergo continuous compacting action given by internal wall surfaces of the respective irregular passageways 32, 33. As a result, a continuous convective phenomenon appears in the mixed materials themselves especially in radial directions in section, whereby a primary mixing operation is carried out.

Next, the partition wall 35 at the inlet-side edge portion of the second-stage element 31 orthogonally intersects the partition wall 36 at the outlet-side edge portion of the first-stage element, and therefore the mixed materials A, B extruded out of the outlet-side edge portion of the first-stage element and vertically layered are diverged right and left into an A/B layered mass and another A/B layered mass as illustrated in FIG. 4. Then, it follows that the A/B layered masses of the mixed materials flow through the respective irregular passageways 32, 33. That is, at the inlet-side edge portion of the second-stage element 31, some of the mixed materials A, B become confluent up and down within the irregular passageways 32, 33, and the layered mass within each passageway assumes the lengthwise elongate rectangle in sectional configuration.

Subsequently, at the second-stage intermediate portion, the sectional configuration of each A/B layered mass of the mixed materials is reshaped into the square on the whole, and reshaped into the crosswise elongate rectangle at the outlet-side edge portion. At this second stage also, the A/B layered mass of the mixed materials varies such as: lengthwise elongate rectangle→square→crosswise elongate rectangle. Then, in the process of such variations, it follows that the mixed materials are subjected to the continuous compacting action by the internal wall surfaces of the individual irregular passageways 32, 33. As a result, the continuous convective phenomenon appears in the mixed materials themselves especially in the radial directions in section, whereby a secondary mixing operation is performed.

Although the third stage is not particularly illustrated, at the third-stage inlet-side edge portion, the mixed materials are divided right and left as an added imaginary line X1 indicates and get confluent up and down such as A/B/A/B. Those mixed materials are layered on the last layered mass at the second-stage outlet-side edge portion shown in FIG. 4. After this stage, the mixed materials are mixed as in the case of the first and second stages.

Figure 5:
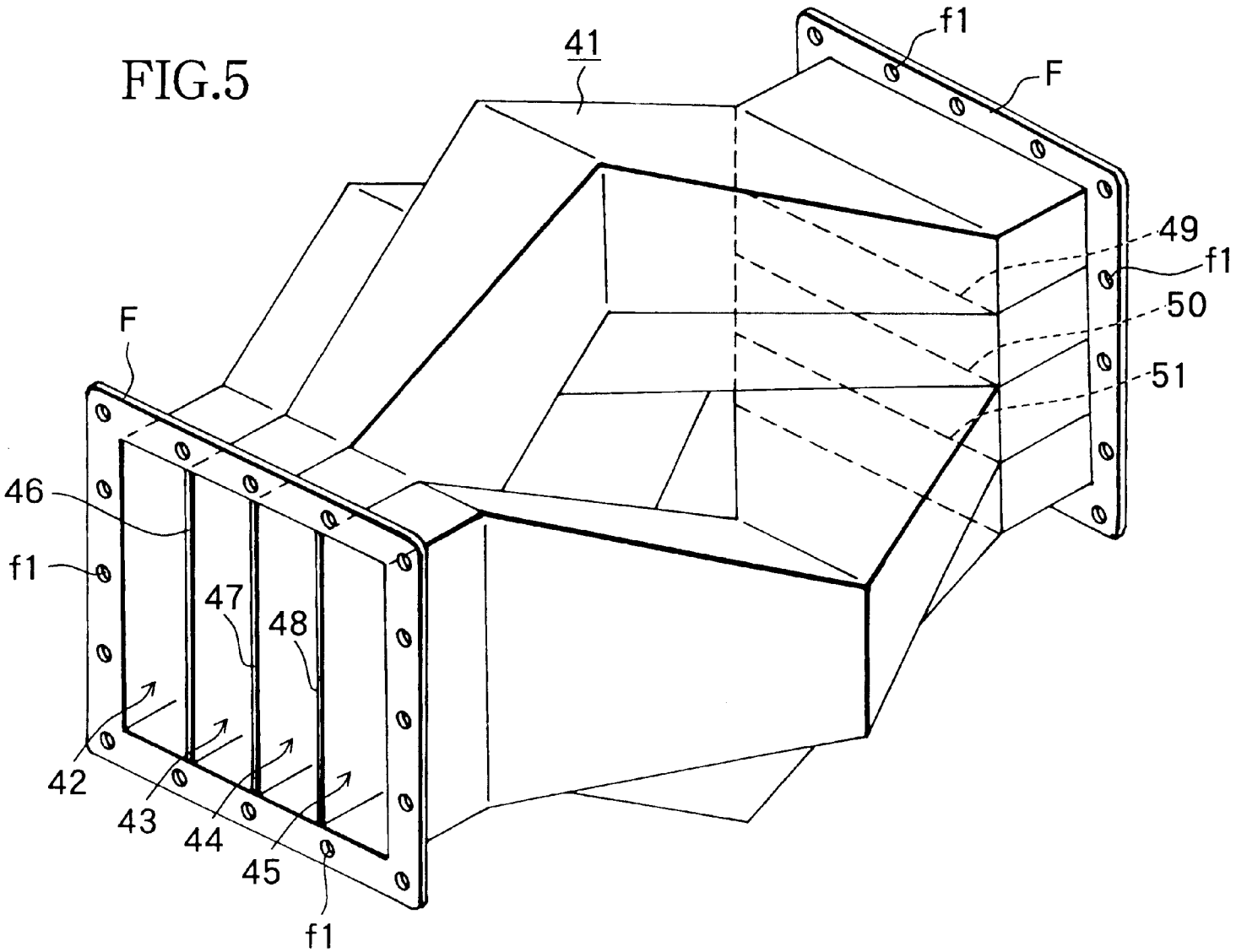
FIG. 5 is a perspective view showing one element partly constituting an apparatus body of the mixing apparatus in a second embodiment of the present invention.

FIG. 5 illustrates one element 41 partly constituting the apparatus body in the mixing apparatus S in accordance with a second embodiment of the present invention. This element 41 includes four irregular passageways 42, 43, 44, 45 based on the same tenor as the first embodiment discussed above. In the second embodiment also, the element 41 has a bore taking the square on the whole at the edge portion including the connection flange F.

The inlets of the respective irregular passageways 42, 43, 44, 45 are, however, formed in narrow elongate rectangular shapes, wherein the square bore at the inlet-side edge portion of the element 41 is lengthwise divided into four bore segments by three partition walls 46, 47, 48 extending lengthwise. Further, the respective outlets are formed in the crosswise narrow elongate rectangular shape by partition walls 49, 50, 51 extending crosswise. The inlet of the irregular passageway communicates with the outlet that is the second from above. The inlet of the irregular passageway 43 communicates with the uppermost outlet, and the inlet of the irregular passageway 44 communicates with the lowermost outlet. The inlet of the irregular passageway 45 communicates with the outlet that is the third from above.

The variations in sectional configuration of each of the irregular passageways 42, 43, 44, 45 in their longitudinal directions, are basically the same as those in the element 31 shown in the preceding embodiment. An entire outline of the element 41 is, however, different because of having the four irregular passageways.

Figure 6:
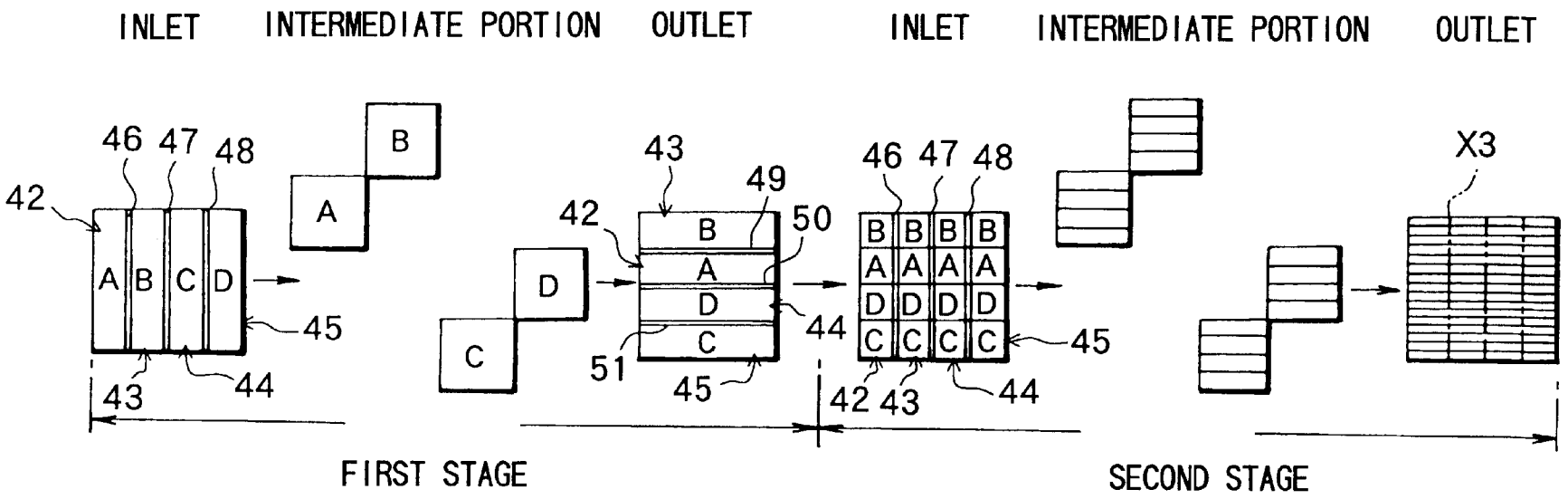
FIG. 6 is a step diagram showing a mixing step modelwise by use of the mixing apparatus in the second embodiment of the present invention.

FIG. 6 is a diagram showing steps of the mixing method using the apparatus body constructed of the two elements 41 connected to each other. Accordingly, the bore at the inlet-side edge portion of each of the first- and second-stage elements 41 is partitioned in such a form that four inlets each assuming a lengthwise narrow elongate shape are arranged. The mixed materials entering the first-stage element 41 are thereby diverged to A, B, C, D and get confluent at the outlet-side edge portion of the second-stage element 41 such that the mixed materials are superposed in 16 layers each assuming the crosswise elongate shape. Herein, an imaginary line X3 indicates a next three-stage dividing line.

Figure 7:
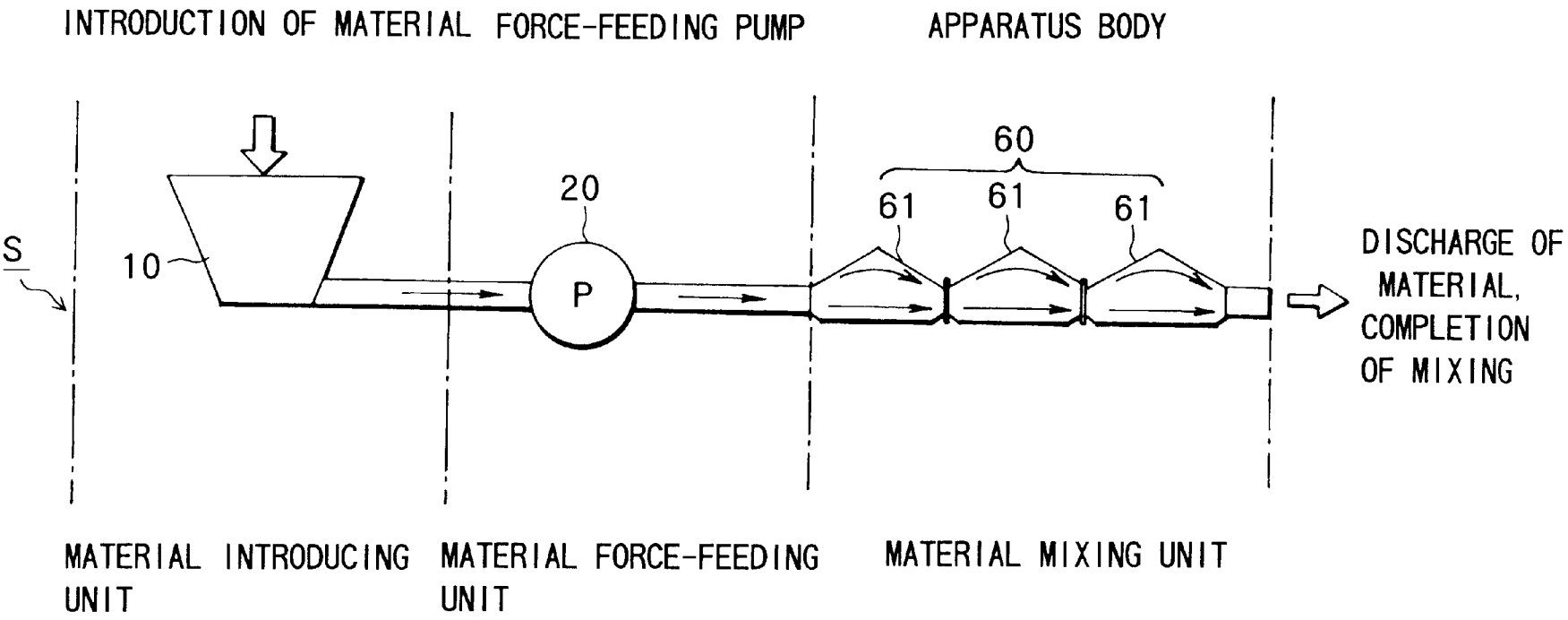
FIG. 7 is a diagram showing an outline of construction of the mixing apparatus in a third embodiment of the present invention.
Figure 8:
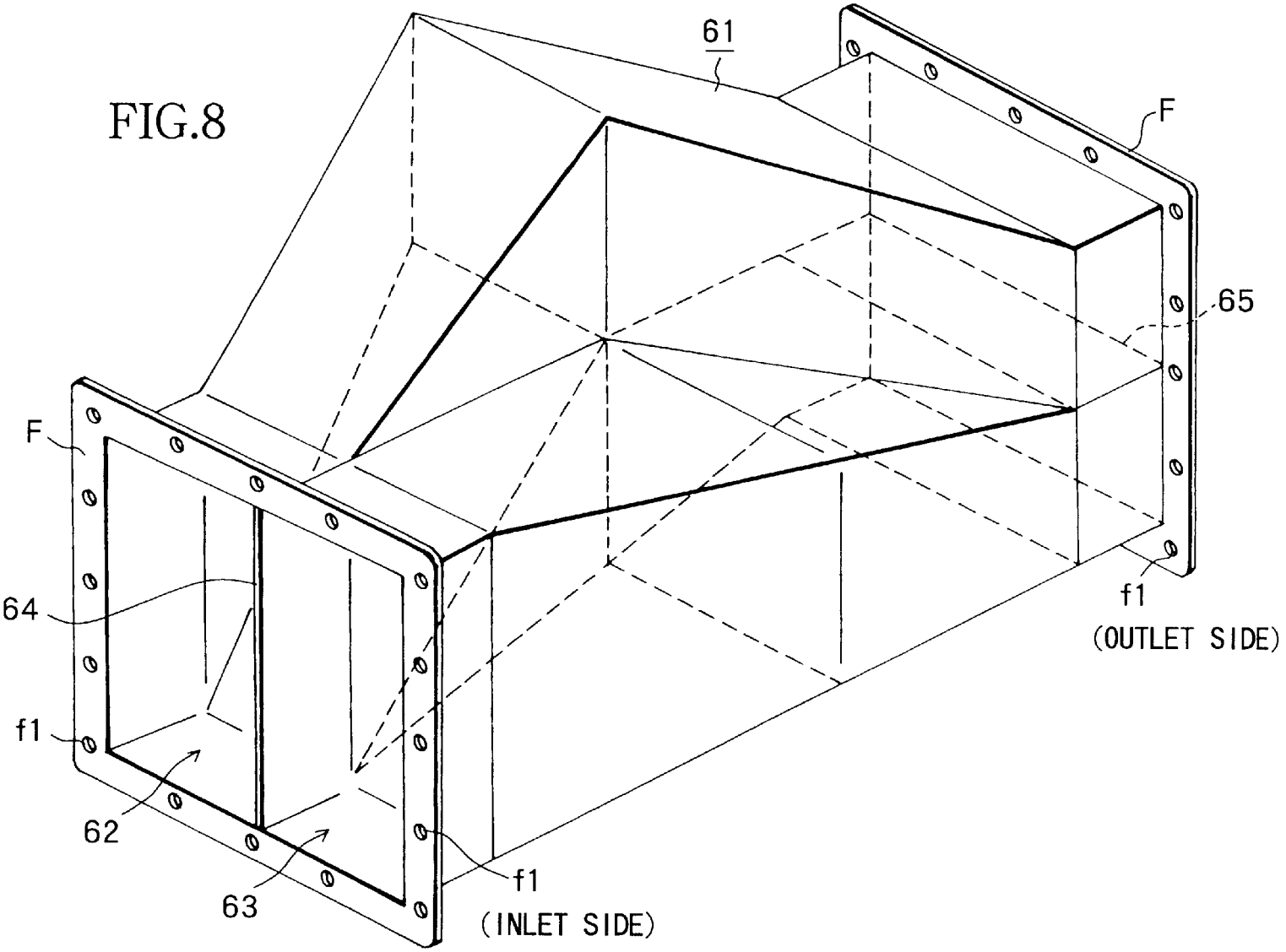
FIG. 8 is a perspective view illustrating one element partly constituting the apparatus body of the mixing apparatus in the third embodiment of the present invention.
Figure 9:
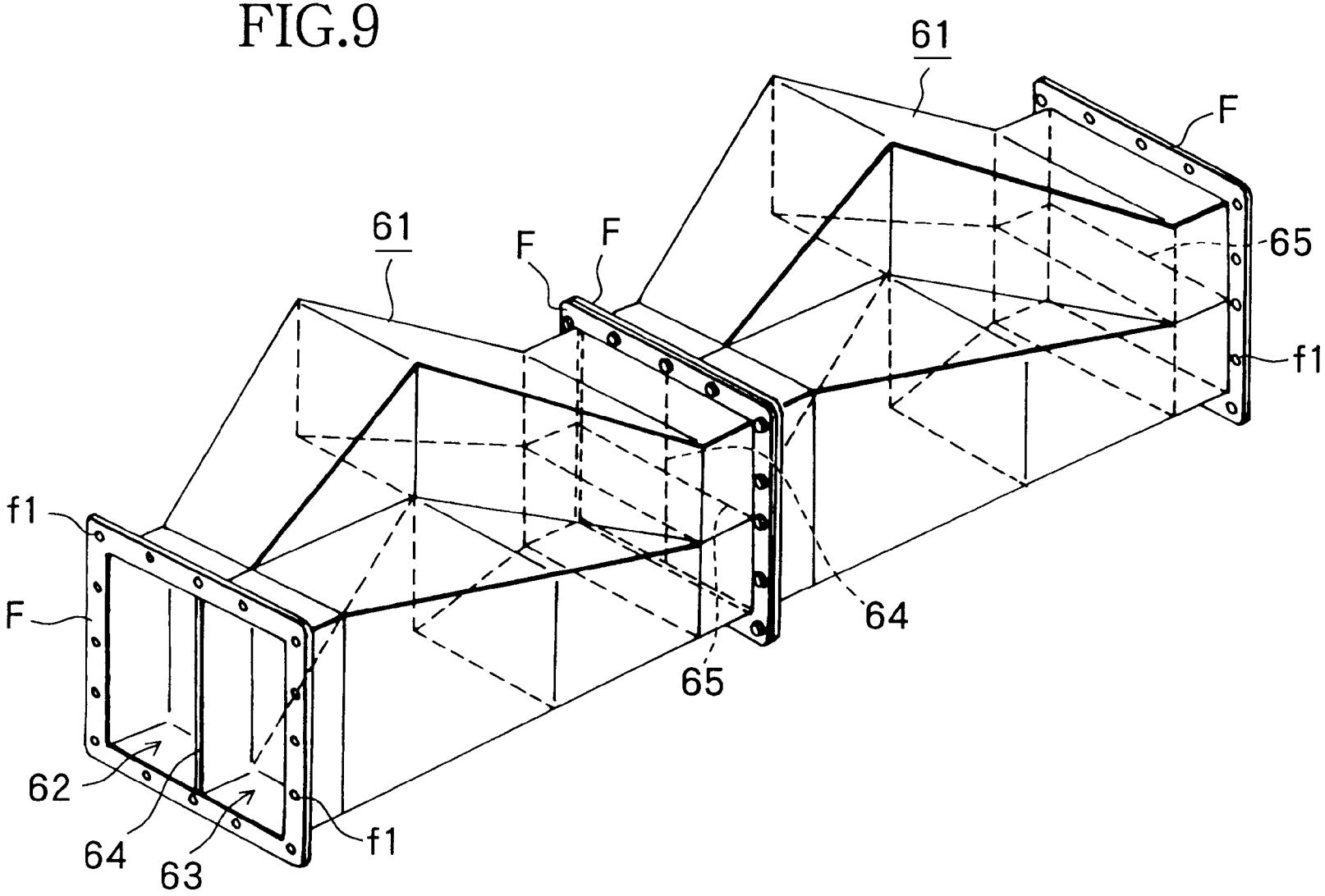
FIG. 9 is a perspective view showing a state where the two elements shown in FIG. 8 are connected in series.

FIG. 7 is a view illustrating an outline of construction of the mixing apparatus S in accordance with a third embodiment of the present invention. FIG. 8 is a perspective view showing one element 61 partly constituting the apparatus body of this mixing apparatus S. FIG. 9 is a perspective view illustrating a state where two elements 61 are connected to each others The mixing apparatus S in accordance with a third embodiment shown in FIG. 7 has substantially the same construction as that of the mixing apparatus S in the first embodiment illustrated in FIG. 1 other than a different construction of the element. Accordingly, in the third embodiment, only the element 61 partly constituting the apparatus body will be explained.

The edge portions of the respective elements 61 are, as depicted in FIGS. 8 and 9, provided with flanges F for connecting the elements 61 to each other. These elements 61 are connected in series by fastening the flanges F to each other by tightening bolts into a plurality of bolt holes f1 formed in the flanges F.

Each element 61 includes two irregular passageways 62, 63 disposed in the side-by-side relationship in the same direction. As illustrated in FIG. 9, the edge portion of one element 61, which portion is formed with outlets of the irregular passageways 62, 63, is connected to the edge portion of the other element 61 that is formed with inlets. Then, the confluent/diverging unit for the mixed materials at the intermediate portion within the apparatus body consists of the outlets and inlets of the respective irregular passageways, which are formed the outlet-side edge portion and the inlet-side edge portion that serve as the connecting portion between the two elements 61.

More specifically, referring to FIG. 9, as viewed from the edge surface of the element 61, square bores at one edge portion and the other edge portion of the element 61, are formed with two inlets and two outlets each partitioned by partition walls 64, 65 at their centers. However, the partition wall 74 at the inlet-side edge portion of the element and the partition wall 65 at the outlet-side edge portion of the element, are disposed in directions different 90 degrees from each other. Accordingly, an arrangement pattern of the two inlets of the irregular passageways 62, 63 is such that the rectangular bores are formed right and left in the side-by-side relationship, while an arrangement pattern of the two outlets thereof is that the rectangular bores are formed up and down in the side-by-side relationship. A required number of such elements 61 are so employed as to be connected in series, and it follows that the confluent/diverging unit for the mixed materials is constituted at each connecting portion.

Next, specific configurations of the irregular passageways 62, 63 will be described. A sectional configuration of each of the irregular passageways 62, 63 continuously varies as it extends from the inlet toward the outlet. In terms of a variation form thereof, a sectional area in an arbitrary position remains the same at the inlet through the outlet, and only the sectional configuration continuously varies. To be specific, the inlet assumes a lengthwise elongate rectangular shape; the intermediate portion between the inlet and the outlet takes a square shape in its sectional configuration; and the outlet assumes a crosswise elongate rectangular shape.

Hence, the mixed materials passing through the respective irregular passageways 62, 63 are varied in their sectional configurations so that the lengthwise elongate rectangle is gradually reshaped into the square and further reshaped little by little therefrom into the crosswise elongate rectangle. Then, as stated above, the outlets are disposed at the outlet-side edge portion with such a pattern that the two crosswise elongate rectangles are arranged up and down in the side-by-side relationship. It therefore follows that the mixed materials coming out of the outlet-side edge portion of the element 61 are further equally halved right and left at the inlet-side edge portion of the next element 61 subsequent thereto. These varied states of the mixed materials correspond to the confluence and divergence connoted according to the present invention.

The irregular passageways 62 and 63 are different in terms of their lengths as illustrated in the Figure. That is, the irregular passageway 62 is bent upward, while the irregular passageway 63 extends substantially straight. As a result, the irregular passageway 62 is substantially longer than the irregular passageway 63. Hence, the mixed materials flowing through the irregular passageway 62 reach the outlet of the element 61 later than the mixed materials flowing through the irregular passageway 63, with the result that these two masses of mixed materials get confluent at a staggered timing.

The mixed state in the case of employing the mixing apparatus S in the third embodiment discussed above is, as described above, substantially the same as the mixed state shown in the step diagram of FIG. 4, except for the fact that there is the difference in the arrival time between the mixed materials flowing through the irregular passageway 62 and the mixed materials flowing through the irregular passageway 63 at the outlet-side edge portion of the element 61.

Figure 10:
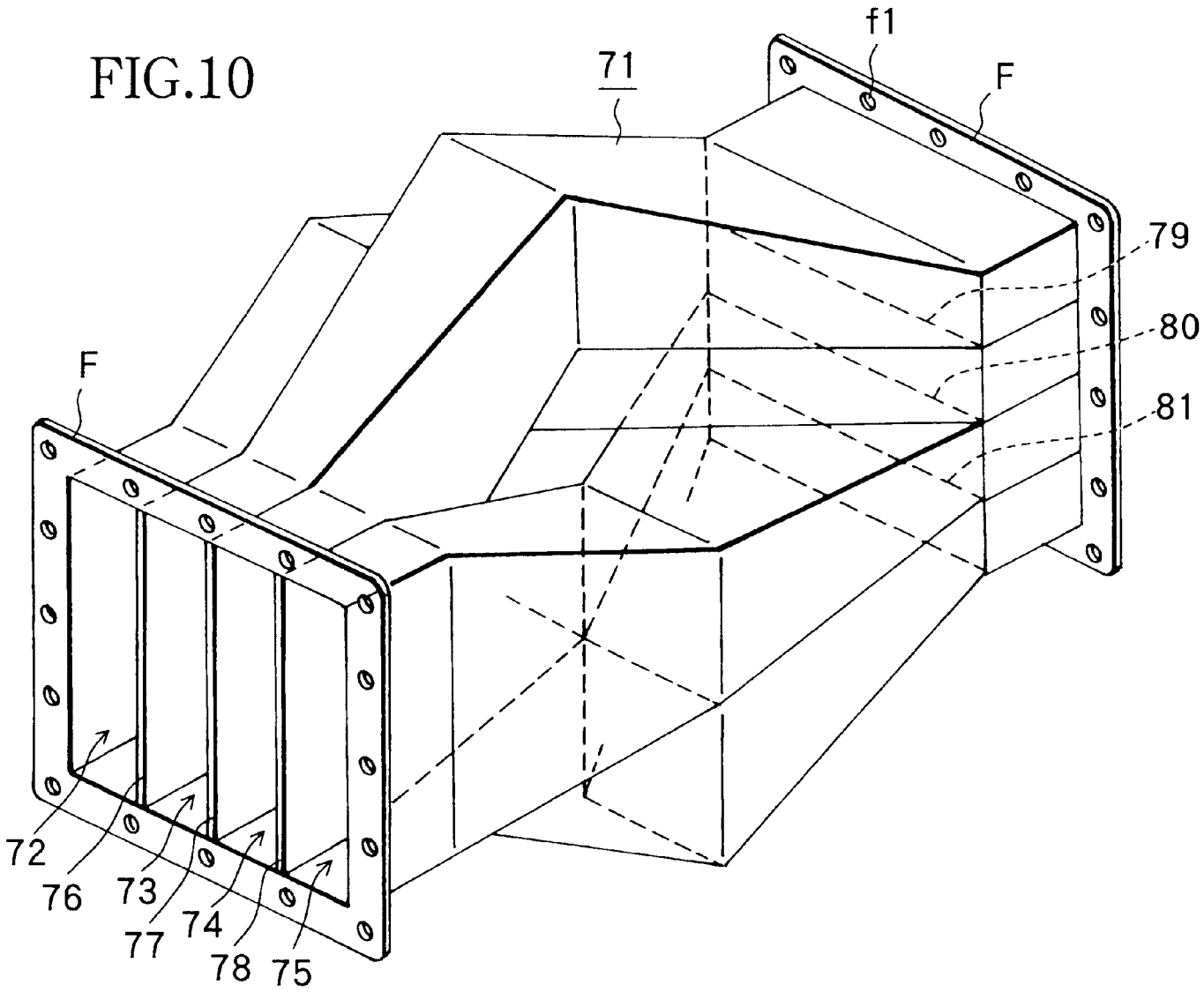
FIG. 10 is a perspective view illustrating one elements partly constituting the apparatus body of the mixing apparatus in accordance with a fourth embodiment of the present invention.

FIG. 10 shows one element 71 partly constituting the apparatus body in the mixing apparatus S in accordance with a fourth embodiment of the present invention. This element 71 includes four irregular passageways 72, 73, 74, 75 based on the same general idea as the third embodiment discussed above. In the fourth embodiment also, the element 71 has a bore taking the square on the whole at the edge portion including the connection flange F.

The inlets of the respective irregular passageways 72, 73, 74, 75 are, however, formed in narrow elongate rectangular shapes, wherein the square bore at the inlet-side edge portion of the element 71 is lengthwise divided into four bore segments by three partition walls 76, 77, 78 extending lengthwise. Further, the respective outlets are formed in the crosswise narrow elongate rectangular shape by partition walls 79, 80, 81 extending crosswise.

The variations in sectional configuration of the respective irregular passageways 72, 73, 74, 75 in their longitudinal directions are fundamentally the same as those in the element 61 shown in the preceding embodiment. In the fourth embodiment, however, lengths of the individual irregular passageways 72, 73, 74, 75 are all different. To be specific, the irregular passageway 73 is formed longest; next the irregular passageways 72, 74 follow in this sequence; and the irregular passageway 75 is formed shortest.

Figure 11:
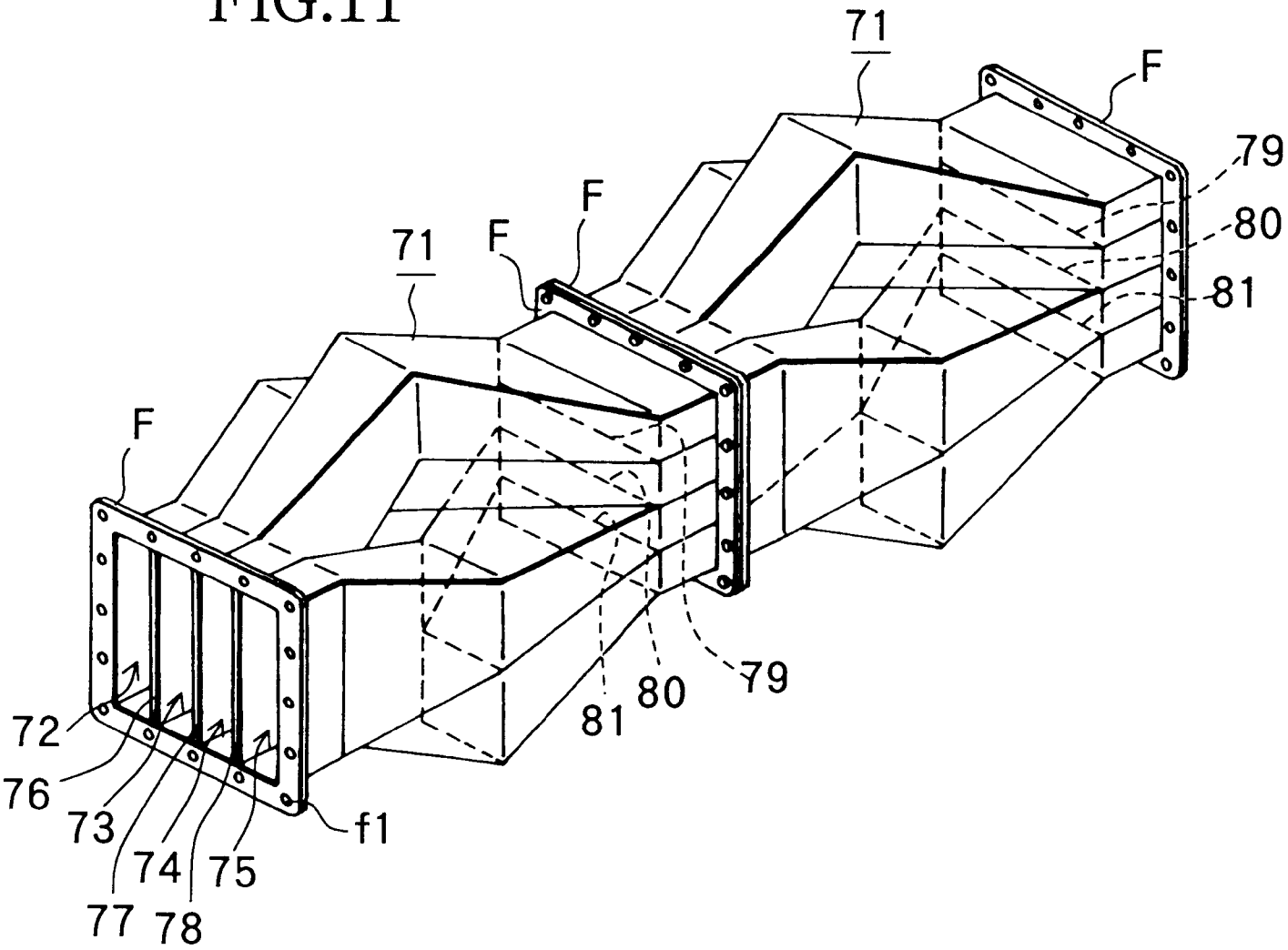
FIG. 11 is a perspective view illustrating a state where two elements shown in FIG. 10 are connected in series.

These respective elements 71 are, as illustrated in FIG. 11, connected in series by fastening the flanges F to each other by tightening bolts into the plurality of bolt holes f1 formed in the flanges F. When the plurality of elements 71 are thus connected, the confluent/diverging unit for the mixed materials is constructed at the connecting portion therebetween as in the embodiments discussed above.

The mixed state in the case of employing the mixing apparatus S in the fourth embodiment is, as described above, substantially the same as the mixed state shown in the step diagram of FIG. 6, except for the fact that there are differences in the arrival time between the mixed materials flowing through the irregular passageways 72–75 to the outlet-side edge portion of the element 71.

Thus, the mixing action is further produced in the back-and-forth directions by changing the length of each irregular passageway, and hence it can be comprehended that making the lengths of all the irregular passageways different from each other is highly preferable in terms of a further enhancement of mixing efficiency. Concerning how the lengths of the respective irregular passageways are set, as a matter of course, the length of at least one irregular passageway may be different from the lengths of other irregular passageways.

As described above, it is feasible to exhibit the mixing action not only in the sectional directions but also in the so-called back-and-forth directions by staggering the mutual confluent timing (control over the confluence) of the masses of mixed materials flowing through the irregular passageways. From the point of view of staggering the confluent timing as stated above, there can be contrived methods of changing a thickness of each irregular passageway or providing bypasses.

Figure 12:
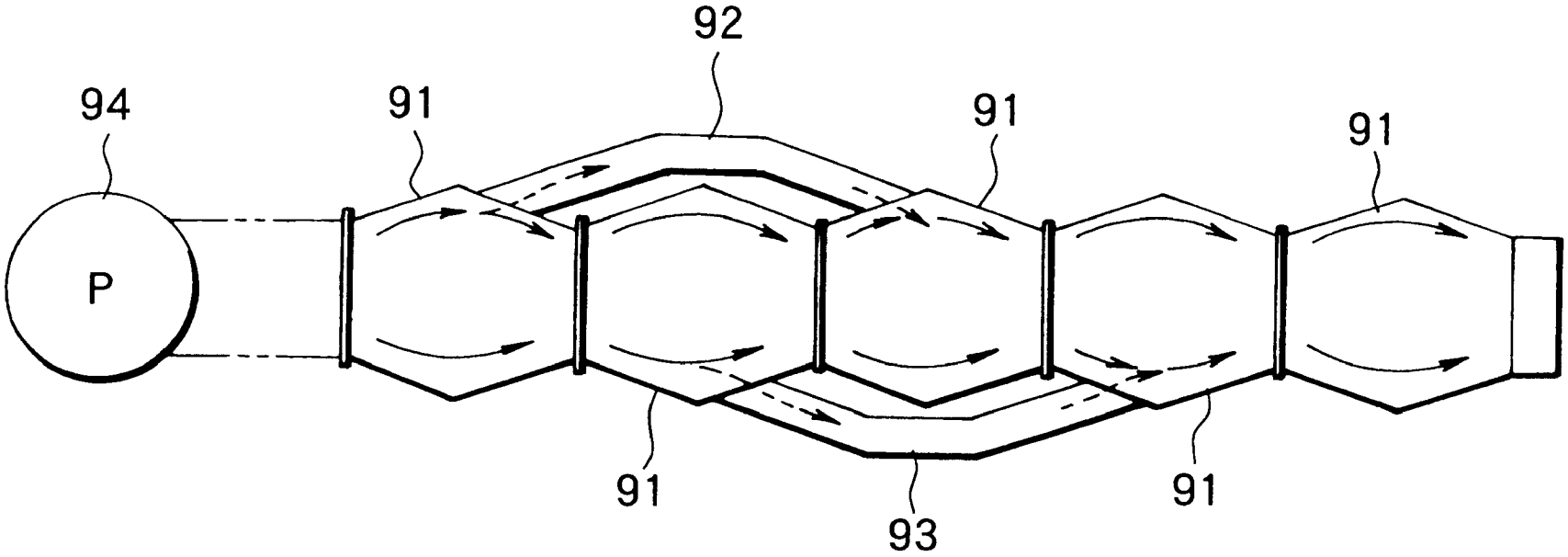
FIG. 12 is a diagram illustrating an outline of construction of the mixing apparatus in a fifth embodiment of the present invention.

FIG. 12 conceptually illustrates the mixing apparatus S in accordance with a fifth embodiment of the present invention. In this mixing apparatus S, the confluence is controlled by providing the bypasses. The fifth embodiment will hereinafter be discussed. The mixing apparatus S includes a multiplicity of elements 91 connected in series. Then, some elements 91 are provided with bypasses 92, 93. One irregular passageway of the first-stage element 91 communicates via the bypass 92 with one irregular passageway of the third-stage element 91. The irregular passageways of the second- and fourth-stage elements communicate via the bypass 93 with each other.

Accordingly, when the mixed materials are pressurized and fed into the first-stage element 91 by a pump 94, in the course of flowing through the respective irregular passageways of the first-stage element 91, the mixed materials flowing a certain irregular passageway are bypassed via the bypass 92 (hereinafter expressed such as "bypassed 92") into the irregular passageway of the third-stage element 91. Further, the mixed materials flowing through the irregular passageways of the second-stage element 91 are bypassed 93 into the irregular passageway of the fourth-stage element 91 As a result, the mixed materials flowing the respective irregular passageways of the elements 91 get confluent and are diverged before and after, whereby the confluence control is continuously executed.

On the other hand, when examining a method of introducing the mixed materials into the mixing apparatus, there can be considered a case where an additional material introduction from portions excluding the inlet might be also better than the pressure-introduction from only the inlet of the first-stage element 91.

Figure 13:
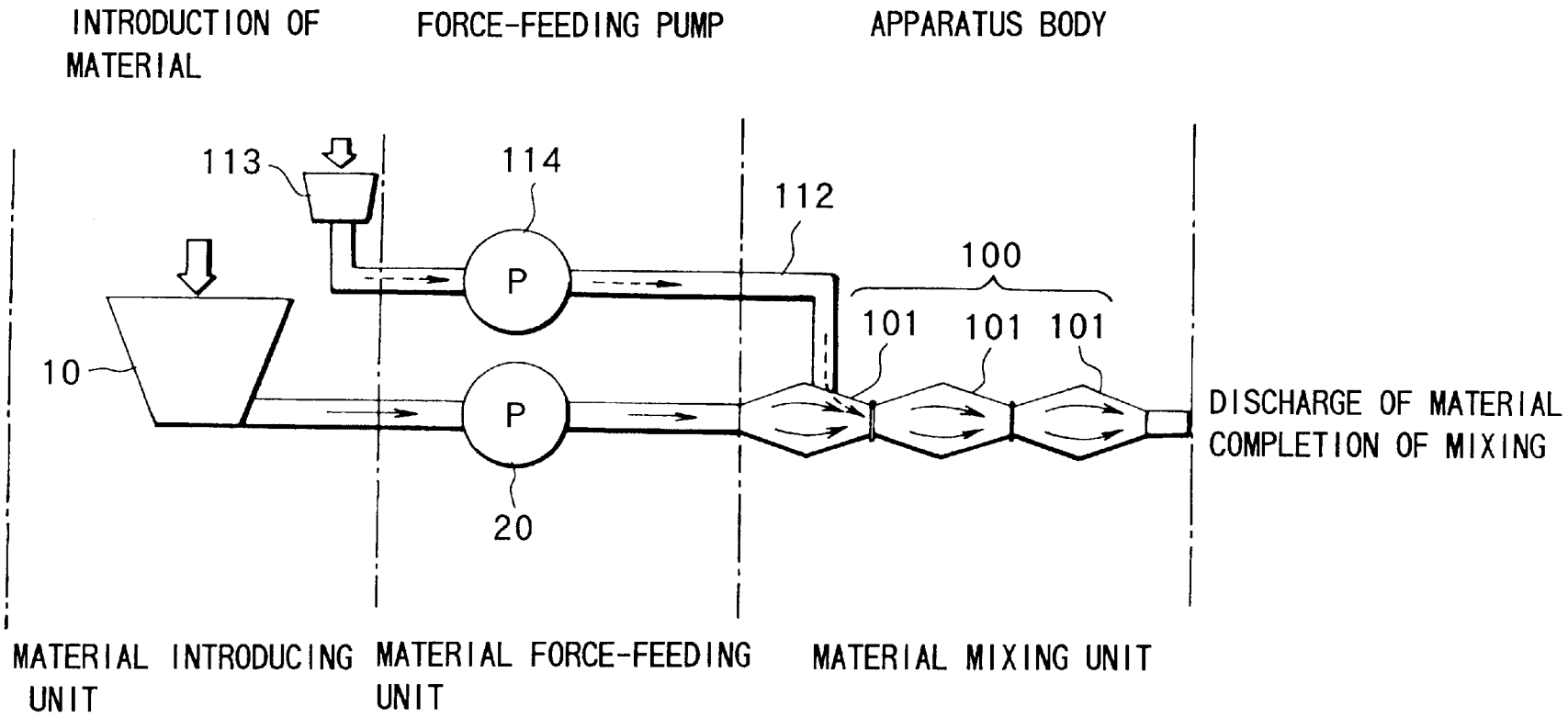
FIG. 13 is a diagram showing an outline of construction of the mixing apparatus in a sixth embodiment of the present invention.
Figure 14:
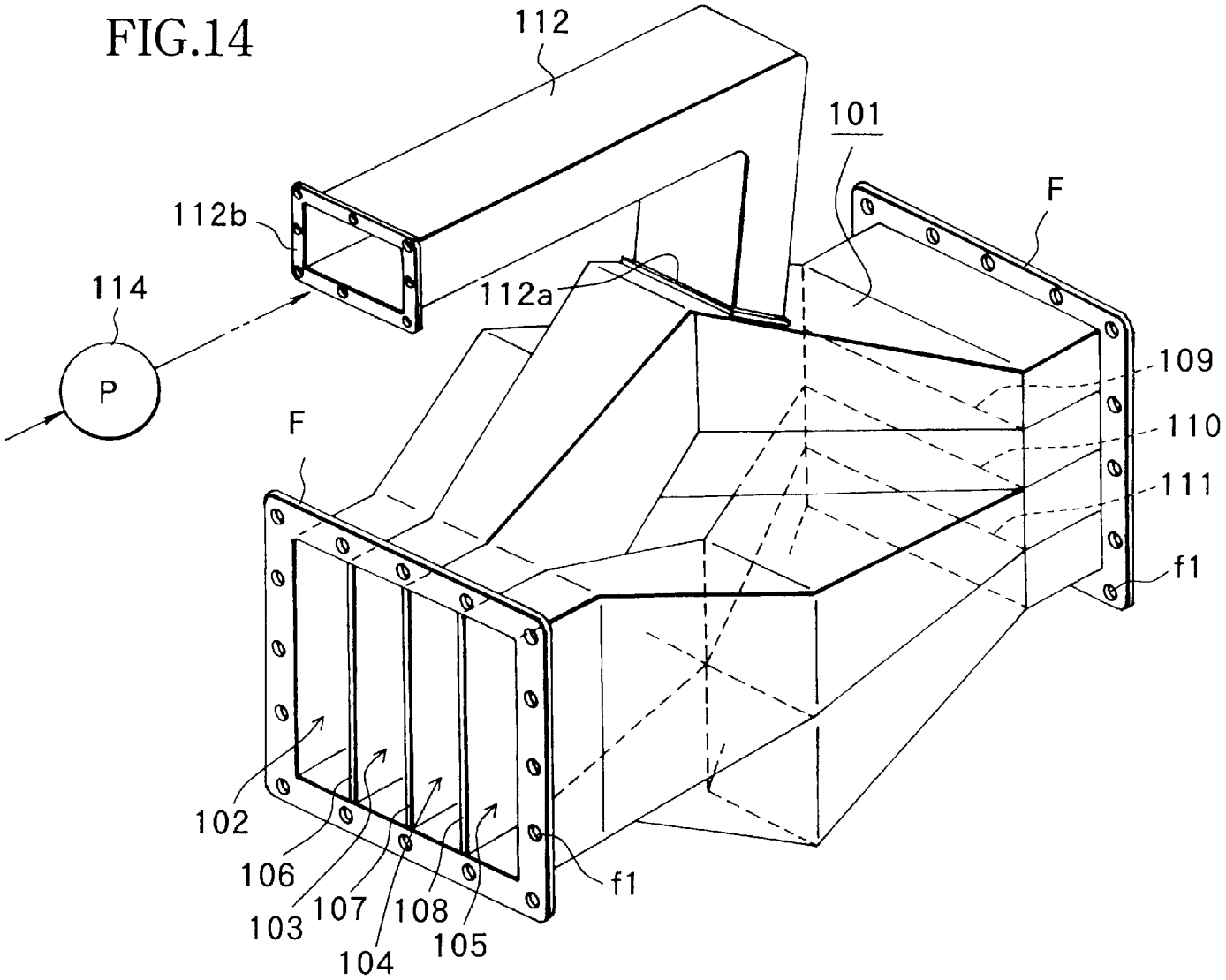
FIG. 14 is a perspective view showing one element partly constituting the apparatus body of the mixing apparatus in the sixth embodiment of the present invention.

FIG. 13 conceptually shows the mixing apparatus S in a sixth embodiment preferable to embody the above concept. FIG. 14 illustrates one element 101 partly constituting the apparatus body of the mixing apparatus S in the sixth embodiment. As can be understood from FIGS. 13 and 14, the mixing apparatus S in this embodiment is constructed such that at least one of the elements 101 so used as to be connected in series includes an outside introduction pipe 112.

Then, a material force-feeding unit for force-feeding the material from a material introduction hopper 113 by a force-feeding pump 114, is connected to the outside introduction pipe 112. As a matter of course, the mixing apparatus S is constructed so that the main mixed materials are fed by pressurization into an apparatus body 100 from the material introducing unit including a hopper 10 by the force-feeding pump 20.

A desirable position for providing the element 101 with the outside introduction pipe 112 may be set outside the irregular passageway 103 positioned upward as shown in FIG. 14 in terms of a manufacturing aspect. Further, a preferable mounting structure thereof is that the outside introduction pipe 112 is so constructed as to be attachable and detachable by providing both edges with flanges 112*a*, 112*b*. Note that the element 101 shown in FIG. 14 has four irregular passageways 102, 103, 104, 105. Accordingly, in this embodiment, the materials are introduced via the outside introduction pipe 112 into the irregular passageway 103.

Incidentally, it can be understood that the element 101 usable herein, if conditioned to include the plurality of irregular passageways, is not particularly limited such as having differences in length and thickness between the irregular passageways or including the bypasses. Moreover, as for the materials to be introduced, the same kind of materials as the main mixed materials or a different kind of materials can be introduced as the necessity arises.

Figure 15:
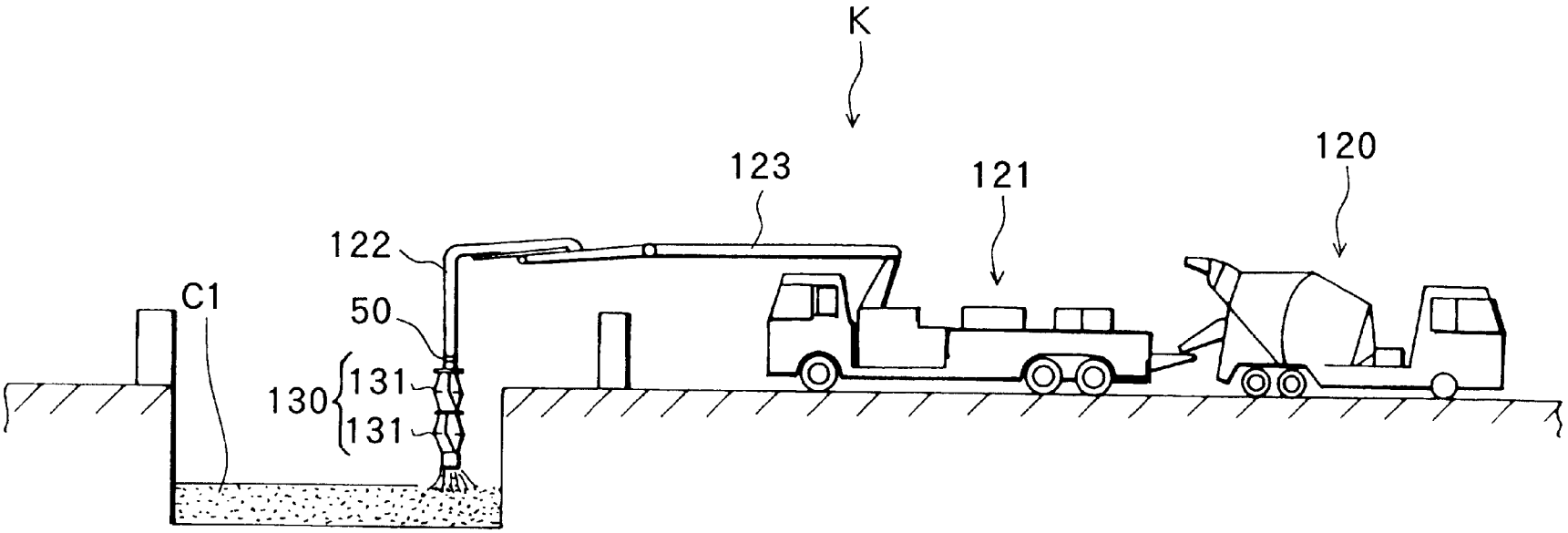
FIG. 15 is an explanatory diagram schematically showing a construction of a mixing apparatus for placing concrete in a seventh embodiment of the present invention, which apparatus is applied to the concrete placing.

FIG. 15 illustrates a concrete placing mixing apparatus K employed for concrete placing in accordance with a seventh embodiment. Generally, in the case of constructing a concrete structure, etc. by placing the concrete, it is required that the concrete be sufficiently mixed beforehand and be placed. The sufficient mixing thereof is capable of securing a necessary uniform fluidity and enhancing a strength of the concrete after being solidified.

Placing the concrete involves the use of a concrete pump vehicle. In the concrete pump vehicle, a hose or a pipe is connected to a discharge unit of a pumping system, whereby the concrete can be easily force-fed to a concrete placing spot located in a relatively high or low position considerably far from the concrete pump vehicle.

When the concrete is thus simply force-fed via the hose or the pipe and placed, however, a segregation phenomenon appears in the concrete itself on the outlet side of the force-feeding path. That is, the concrete is fed in a pressurized state through the force-feeding path by the pump, etc., and hence, in the process of force-feeding, there can be seen a phenomenon in which the concrete flows gradually shifting to such a state that mortar contents having a small particle size and therefore easy to fluidize converge on the external side, while coarse aggregates having a large particle size converge on the internal side.

The above-described segregation phenomenon of the concrete is not generally considered as a serious problem. The reason therefor is that if the force-feeding path for the concrete is comparatively short, the segregation phenomenon is relatively small. Further, it is feasible to place the concrete in the mixed state to such an extent that a practical problem does not occur by a compaction work entailed by the concrete placing.

The problem inherent in the segregation phenomenon of the concrete within the force-feeding path is, however, such that this phenomenon becomes more conspicuous as the force-feeding path get more elongated. Accordingly, when placing the concrete by making use of the hose or the pie also, it is still desirable that a countermeasure be taken in order for the segregation phenomenon not to occur before placing the concrete.

It is because a magnitude of the segregation phenomenon of the concrete, i.e., whether the mixed state is good or bad, might exert an influence upon not only the concrete strength but also the fluidity of the entire placing concrete. Moreover, if the fluidity partially declines due to the segregation phenomenon, the compaction work of the concrete is time-consuming correspondingly.

Figure 16:
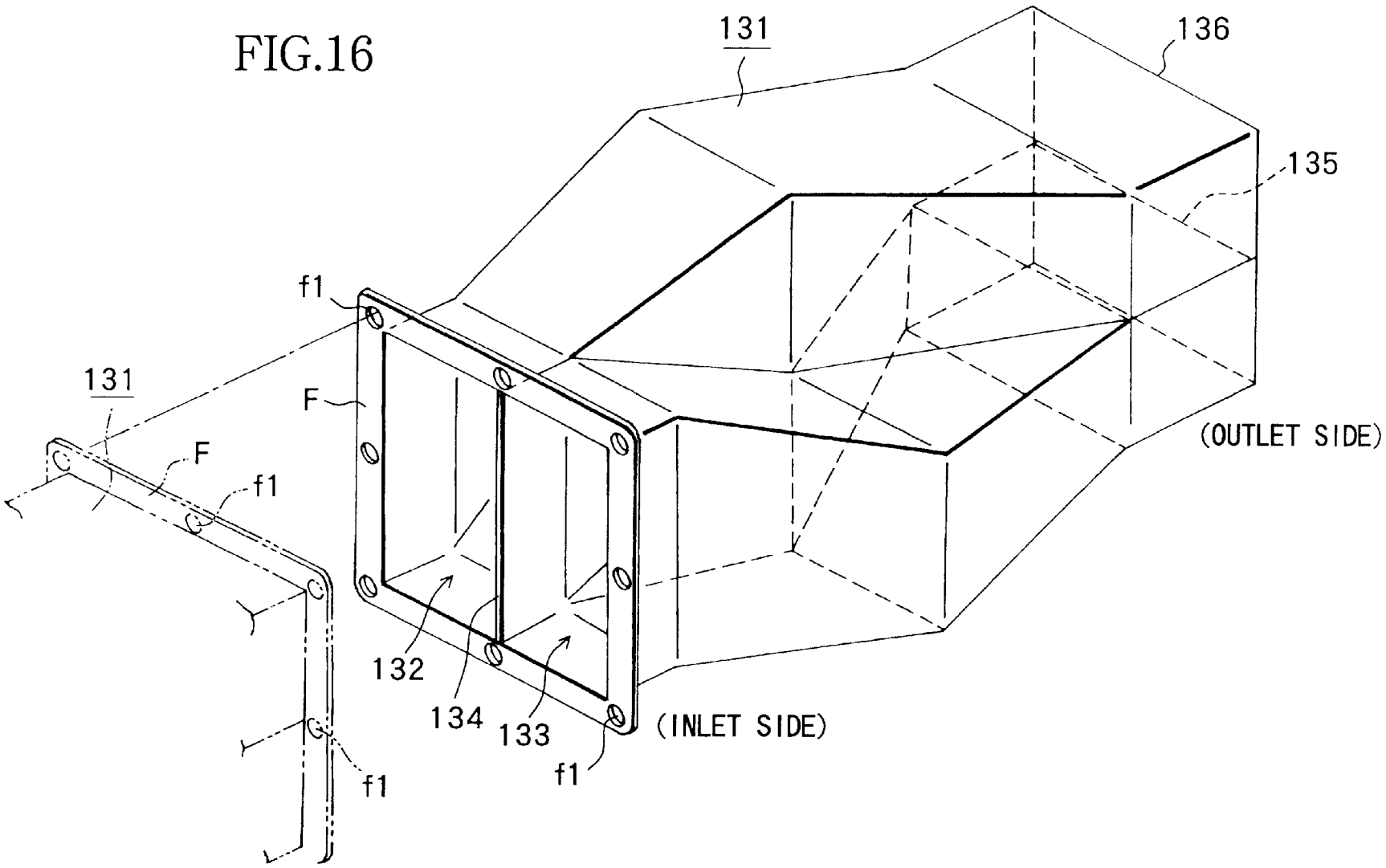
FIG. 16 is a perspective view illustrating one element partly constituting the apparatus body of the mixing apparatus for placing the concrete in the seventh embodiment of the present invention.

Given herein is an explanation of the outline of construction of the mixing apparatus K for placing the concrete in the seventh embodiment of the present invention. The mixing apparatus K for placing the concrete in the seventh embodiment is constructed of a concrete pump vehicle 121 for force-feeding concrete C1 supplied from a concrete mixer vehicle 120, a concrete force-feeding hose 122 one end of which is connected to the pump vehicle 121, and a apparatus body 130 connected to the other end of the hose 122. The apparatus body 130 is constructed of two elements 131 shown in FIG. 16, which are connected in series as illustrated in FIG. 17.

The concrete C1 supplied from the concrete mixer vehicle 120 is previously sufficiently mixed in the same way as the ordinary concrete. Then, the thus mixed concrete C1 is force-fed to the concrete placing spot via a pipe for hose (force-feeding path) 122 for force-feeding the concrete of the concrete pump vehicle 121. The hose 122 is sustained by an arm 123. Normally, this arm 123 incorporates an unillustrated pipe.

A front edge of the hose 122 is directed downward, and the apparatus body 130 is connected via a connecting member 124 to this front edge. The two elements constituting the apparatus body 130 have basically substantially the same construction. These elements 131 are substantially the same as the elements 31 used in the first embodiment shown in FIG. 2, excluding such a point that no flange F is formed along the outlet outer periphery of the element that is at the final stage on the downstream side. Accordingly, a detailed explanation of this element 131 is herein omitted. The concrete C1 to be placed continuously passes through each element 131 of the mixing apparatus S and is thereby mixed or intermingled. The concrete C1 is subsequently discharged from a discharge port 136 and is then placed.

Figure 17:
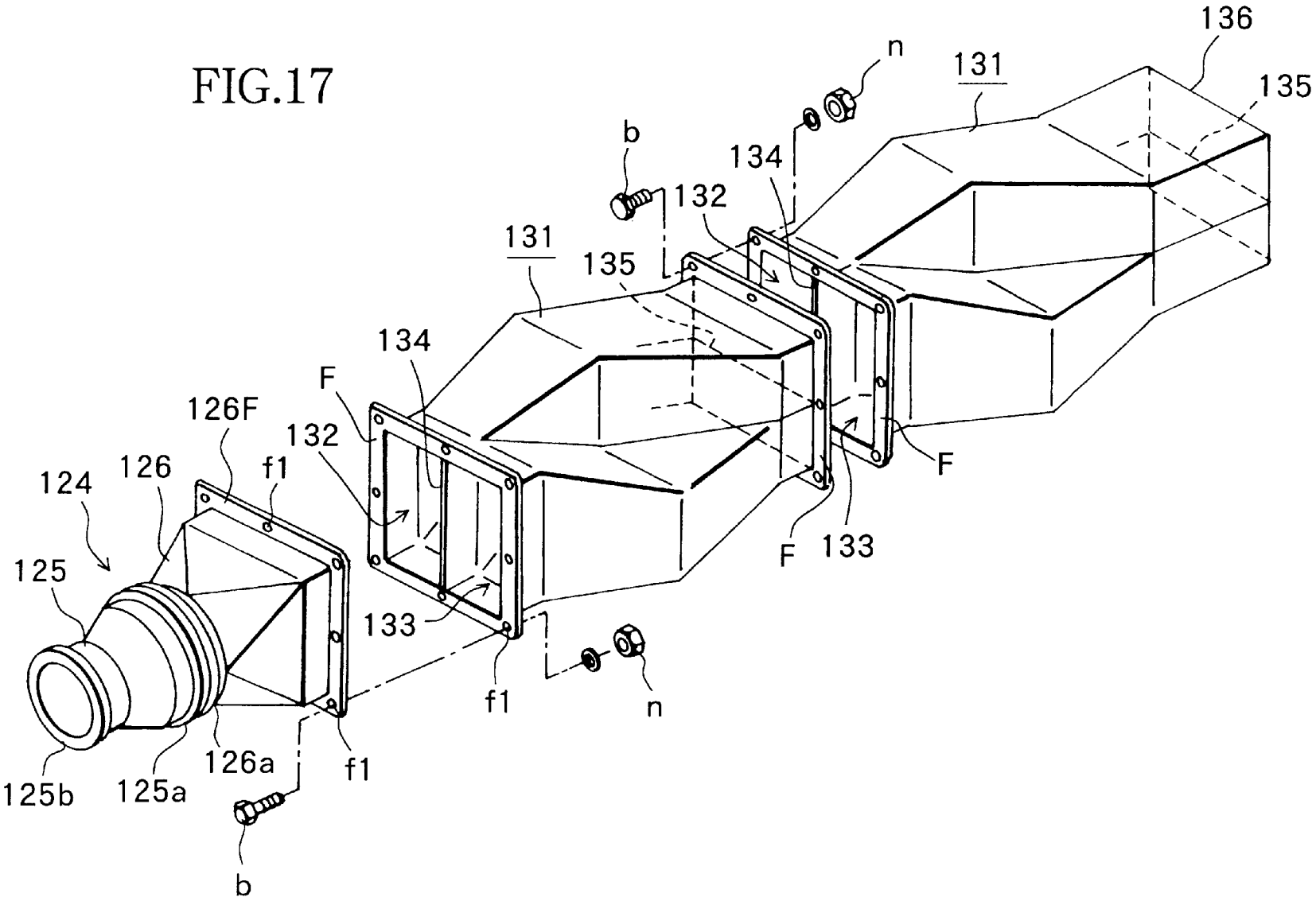
FIG. 17 is an assembly view illustrating a state where the two elements shown in FIG. 16 are connected in series, and a connecting member for connecting these element to a hose is further mounted.

The respective elements 131 are, as shown in FIG. 17, connected in series by inserting bolts b into bolt holes f1 formed therein, tightening nuts n and thus fastening the flanges F provided at the edge portion to each other. The connecting member 124 is attached to the inlet-side edge portion of the first-stage element 131. This connecting member 124 is a joint used for attachably detachably connecting the hose taking a circular shape in section to the element 131 with the edge portion assuming in an angular shape. Hence, this connecting member 124 is, although possible of being provided integrally with the element 131, herein constructed as a separate member because of a large difference in terms of sectional configuration and size between these two members to be connected.

More specifically, this connecting member 124 includes a round reducer 125 and an angular reducer 126. Provided in between the round and angular reducers 125, 126 are a pair of connectors 125*a*, 126*a* for detachably connecting these reducers. The connectors 125*a*, 126*a* involve the use of, e.g., a so-called victoric joint connector often employed as a connector for connecting the hoses 122 to each other.

One connector 125*b*, i.e., the victoric joint connector for detachably connecting the ends of the hoses 122, is similarly provided at the edge portion of the round reducer 125 on the side of the hose 122. Accordingly, it follows that the other connector is provided to the hose 122. The other connector may normally involve the use of a connector provided on the side of the hose as a connector for connecting the hoses to each other.

An edge portion flange 126F is fastened in superposition to the flange F of the element 131 by use of a bolt b and a nut n, is provided at the edge portion of the angular reducer 126 on the side of the element 131. Accordingly, this edge portion flange 126F is also formed with a multiplicity of bolt holes f1.

Figure 18:
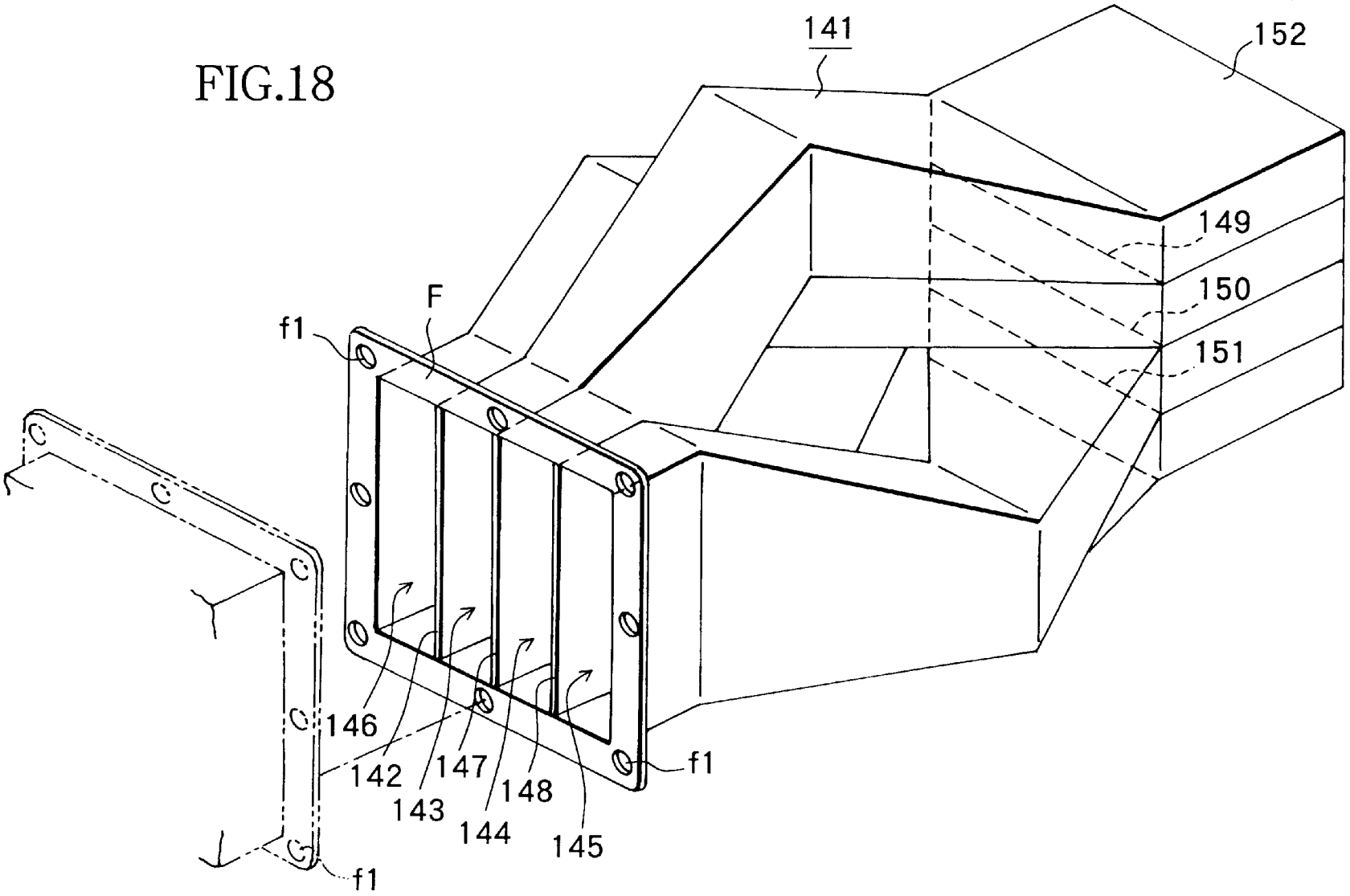
FIG. 18 is a perspective view showing elements in another example that constitute the apparatus body of the mixing apparatus for placing the concrete according to the present invention.

FIG. 18 illustrates another example of the apparatus body of the mixing apparatus K for placing the concrete according to the present invention. This apparatus body comprises two elements 141 connected to each other and including four irregular passageways 142, 143, 144, 145. The element 141 is substantially the same as the element 41 used in the second embodiment shown in FIG. 5, except for such a point that no flange f is provided along the outlet outer periphery of the element at the last stage on the downstream side.

To be specific, a square-shaped inlet edge portion of the element 141 is vertically divided into four bore segments each taking a narrow elongate rectangular shape by three partitions 146, 147, 148 each extending lengthwise, which bore segments serve as inlets of the respective irregular passageways 142, 143, 144, 145. Further, respective outlets are formed in a crosswise elongate rectangular shape by use of three partitions 149, 150, 151 extending crosswise.

According to the mixing apparatus S for placing the concrete that employs the above-described elements 131 or 141, the concrete discharged from an outlet edge 136 or 152 of the element 131 or 141 and then placed, is mixed or intermingled sufficiently before being discharged, and therefore it follows that the concrete is placed in a state where the segregation phenomenon of the concrete is obviated. In this state, the fluidity of the concrete itself is uniform and is not partially biased.

Hence, the concrete compaction work accompanied by the concrete placing gets easier correspondingly. Besides, the concrete strength after being solidified can be set as it is designed. Note that the apparatus is also available by connecting, if necessary, the third-stage element, or connecting the elements at more stages. In terms of preventing the concrete segregation, however, the connections of the elements at approximately two stages can exhibit the effect.

Figure 19:
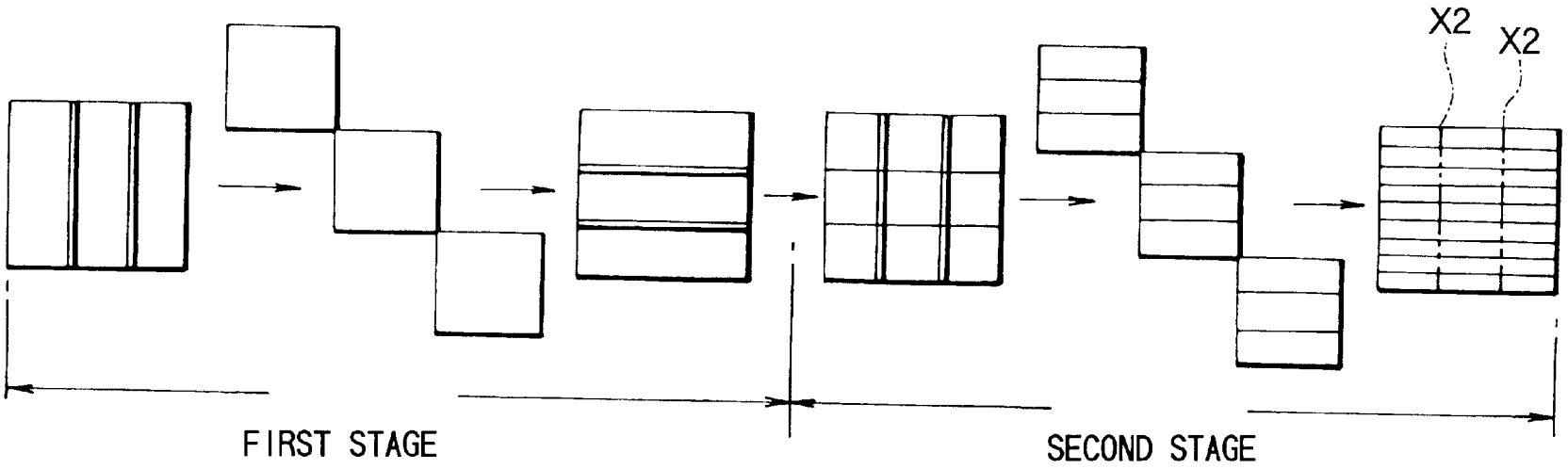
FIG. 19 is a step diagram showing another mixing step modelwise by the apparatus body in the mixing apparatus of the present invention.

FIGS. 19 through 26 illustrate a variety of patterns of the mixing state in the apparatus body of the concrete placing mixing apparatus K and the above-described mixing apparatus S as well according to the present invention. FIG. 19 shows an example corresponding to the element having the three irregular passageways. In this case, the bores at the inlet-side edge portions of the first- and second-stage elements are each partitioned by three partition walls, whereby the respective inlets of the three irregular passageways are formed crosswise in the side-by-side relationship to assume a lengthwise elongate rectangular shape. Then, the bore at the outlet-side edge portion of each element is partitioned so that the respective outlets of the irregular passageways are formed lengthwise in the side-by-side relationship to take the crosswise elongate rectangular shape. Consequently, with respect to the sectional configurations of the mixed materials A, B and C, the mixed materials extruded from the outlet-side edge portions of the second-stage element assume 9-layered crosswise elongate rectangles in section. Herein, imaginary lines X2 indicate dividing lines at the third stage.

Figure 20:
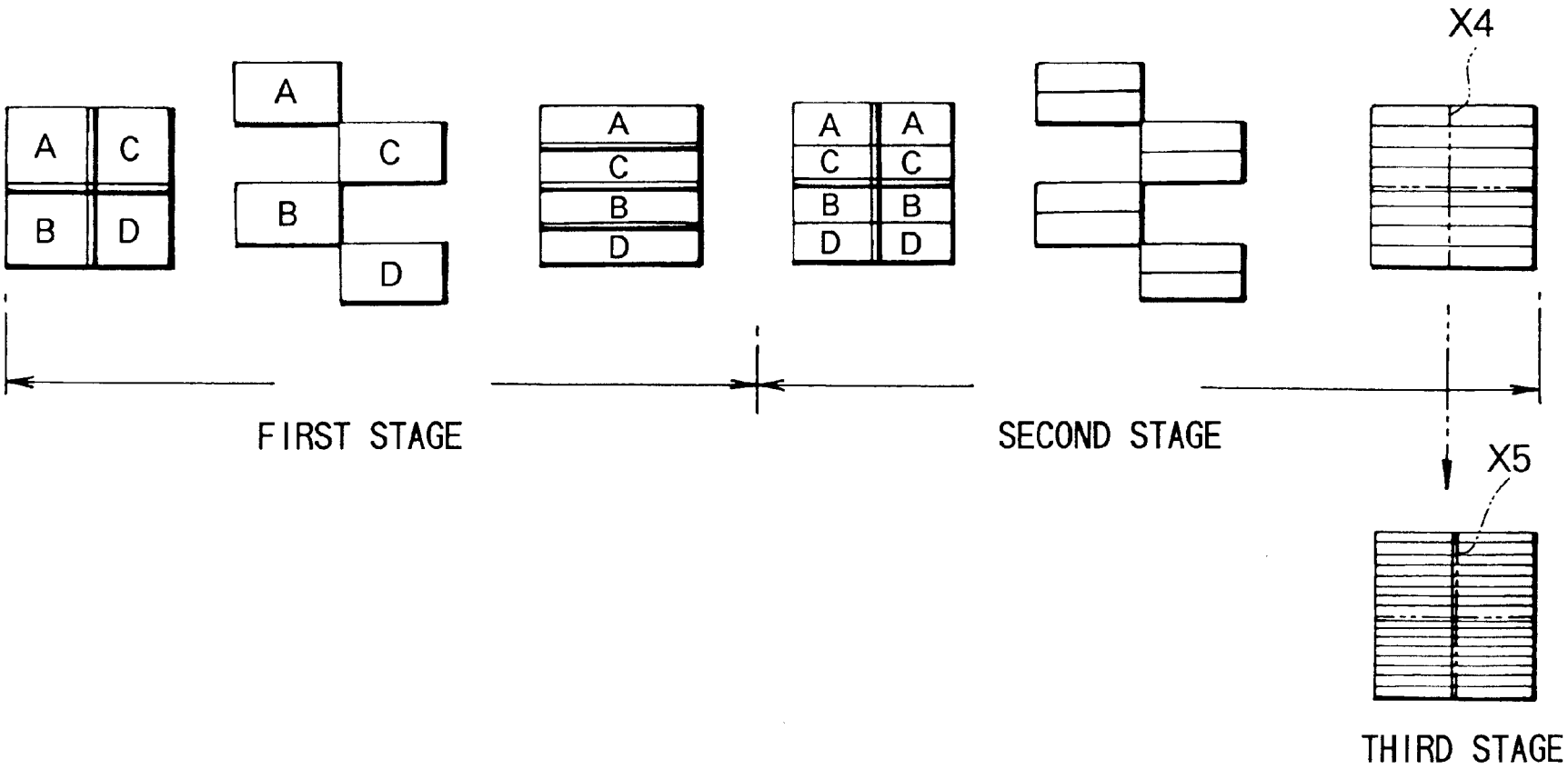
FIG. 20 is a step diagram showing still another mixing step modelwise by the apparatus body in the mixing apparatus of the present invention.

FIG. 20 shows an example corresponding to the element having four irregular passageways. In this case, a bore at the inlet-side edge portion of each of the first- and second-stage elements is partitioned by a cross partition wall, with the result that the respective inlets of the four irregular passageways are arranged crosswise in the side-by-side relationship at two stages lengthwise, each inlet assuming the square shape. Then, the bore at the outlet-side edge portion of each element is partitioned so that the respective outlets of the irregular passageways are formed lengthwise in the side-by-side relationship to assume the crosswise elongate rectangular shape. Accordingly, the mixed materials A, B, C, D are arranged in 8 layers each taking the crosswise elongate shape in section at the second-stage outlet-side edge, and arranged 16 layers at the third-stage outlet-side edge portion. Herein, an imaginary line X4 indicates a third-stage dividing line, and an imaginary line X5 shows a four-stage dividing line.

Figure 21:
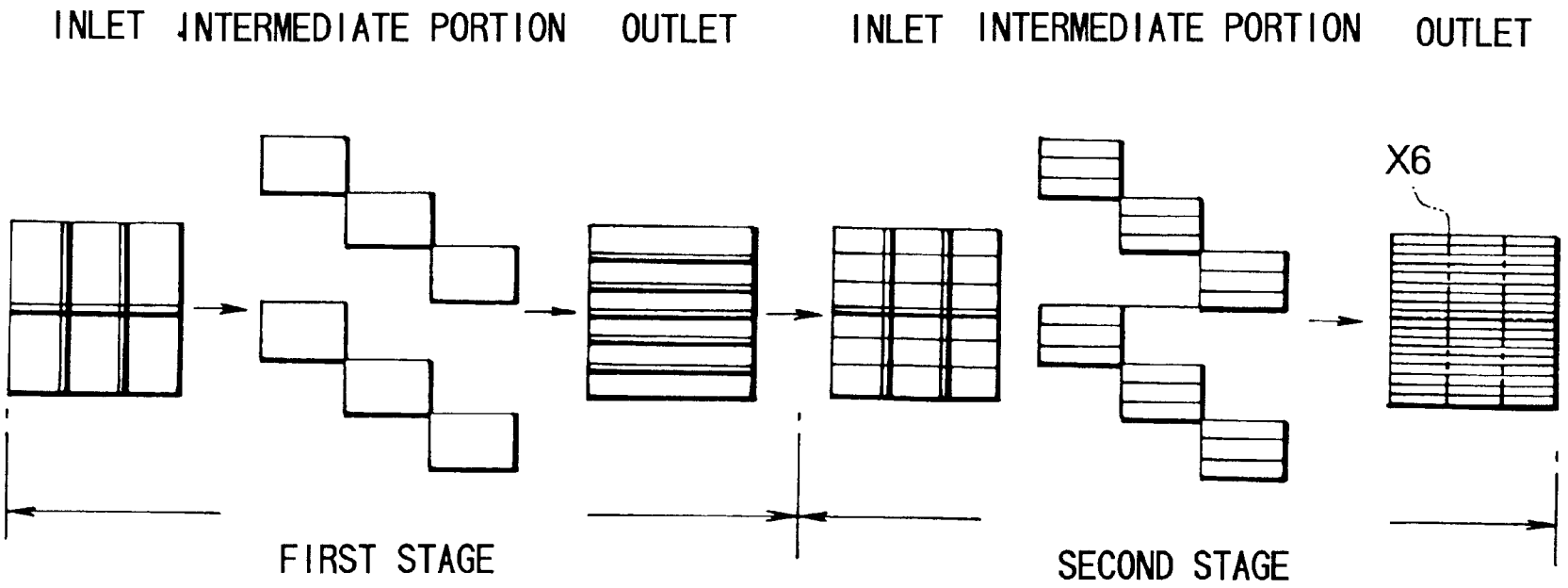
FIG. 21 is a step diagram illustrating yet another mixing step modelwise by the apparatus body in the mixing apparatus of the present invention.

FIG. 21 illustrates an example corresponding to the element including six irregular passageways. In this case, the square-shaped bore at the inlet-side edge portion of each element is partitioned so that the lengthwise elongate rectangular inlets of the respective irregular passageways are arranged crosswise by threes in the side-by-side relationship at two stages. Then, the bore at the outlet-side edge portion of each element is partitioned in such a way that the outlets of the respective irregular passageways are formed lengthwise in the side-by-side relationship to assume the crosswise elongate rectangular shape. Therefore, the mixed materials extruded from the second-stage outlet-side edge portion are arranged in 18 layers each taking the crosswise elongate rectangular shape. Herein, an imaginary line X6 indicates a third-stage dividing line.

Figure 22:
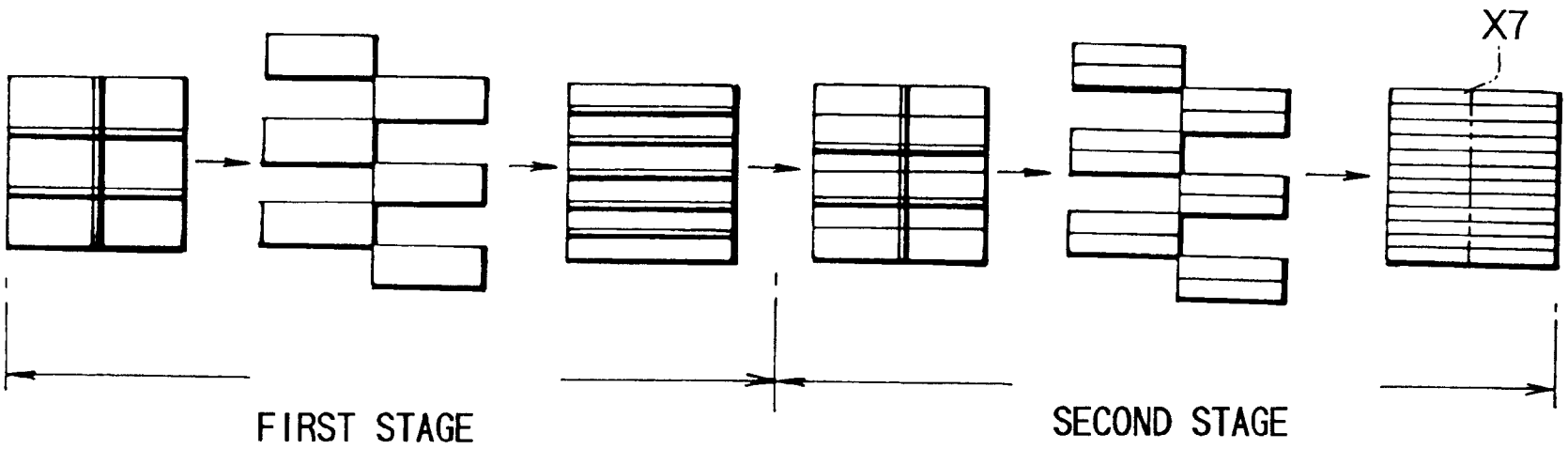
FIG. 22 is a step diagram showing a further mixing step modelwise by the apparatus body in the mixing apparatus of the present invention.

FIG. 22 similarly shows an example corresponding to the element including six irregular passageways. In this case, the square-shaped bore at the inlet-side edge portion of each element is partitioned so that the crosswise elongate rectangular inlets of the respective irregular passageways are arranged crosswise by twos at upper, intermediate and lower stages. Then, the bore at the outlet-side edge portion of each element is partitioned so that the crosswise elongate rectangular outlets of the respective irregular passageways are arranged lengthwise in the side-by-side relationship. Therefore, the mixed materials coming out of the second-stage outlet-side edge portion are arranged in 12 layers each assuming the crosswise elongate rectangular shape in section. Herein, an imaginary line X7 indicates the third-stage dividing line.

Figure 23:
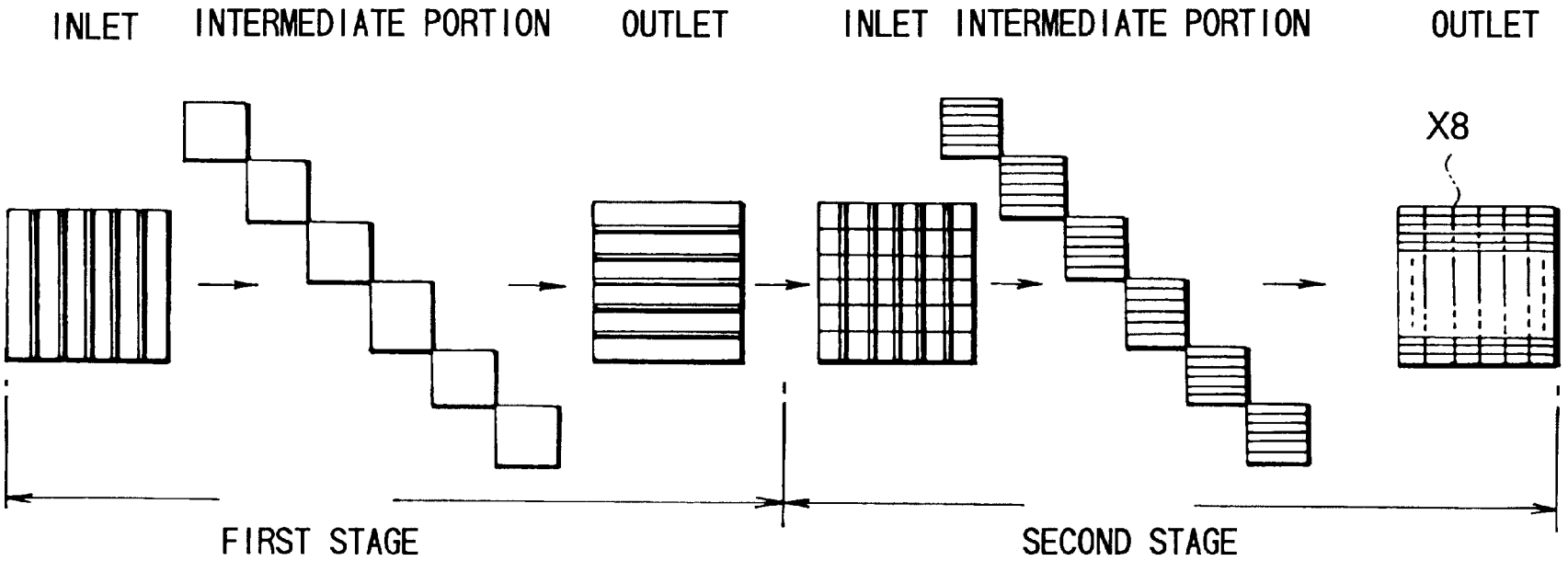
FIG. 23 is a step diagram showing a still further mixing step modelwise by the apparatus body in the mixing apparatus of the present invention.

FIG. 23 similarly shows an example corresponding to the element including six irregular passageways. In this case, the square-shaped bore at the inlet-side edge portion of each element is partitioned so that six pieces of lengthwise elongate rectangular inlets of the respective irregular passageways are arranged crosswise. Then, the bore at the outlet-side edge portion of each element is partitioned so that the crosswise elongate rectangular outlets of the respective irregular passageways are arranged lengthwise in the side-by-side relationship. Therefore, the mixed materials extruded out of the second-stage outlet-side edge portion are arranged in 36 layers each assuming the crosswise elongate rectangular shape in section. Herein, imaginary lines X8 indicate the third-stage dividing lines.

Figure 24:
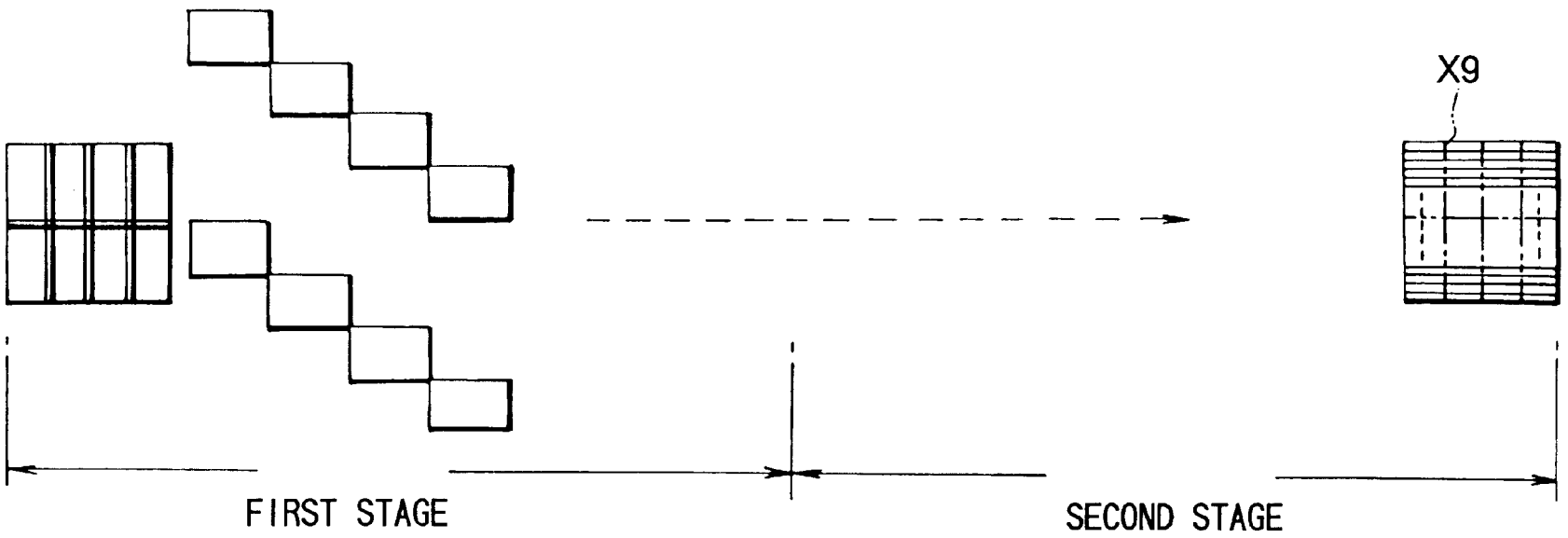
FIG. 24 is a step diagram illustrating a yet further mixing step modelwise by the apparatus body in the mixing apparatus of the present invention.

FIG. 24 shows an example corresponding to the element including eight irregular passageways. In this case, the bore at the inlet-side edge portion of each element is partitioned so that the lengthwise elongate rectangular inlets of the respective irregular passageways are arranged crosswise by fours at two stage lengthwise. Then, the bore at the outlet-side edge portion of each element is partitioned so that the crosswise elongate rectangular outlets of the respective irregular passageways are arranged lengthwise in the side-by-side relationship. Therefore, the mixed materials extruded out of the second-stage outlet-side edge portion are arranged in 32 layers each assuming the crosswise elongate rectangular shape in section. Herein, imaginary lines X9 indicates the third-stage dividing lines.

Figure 25:
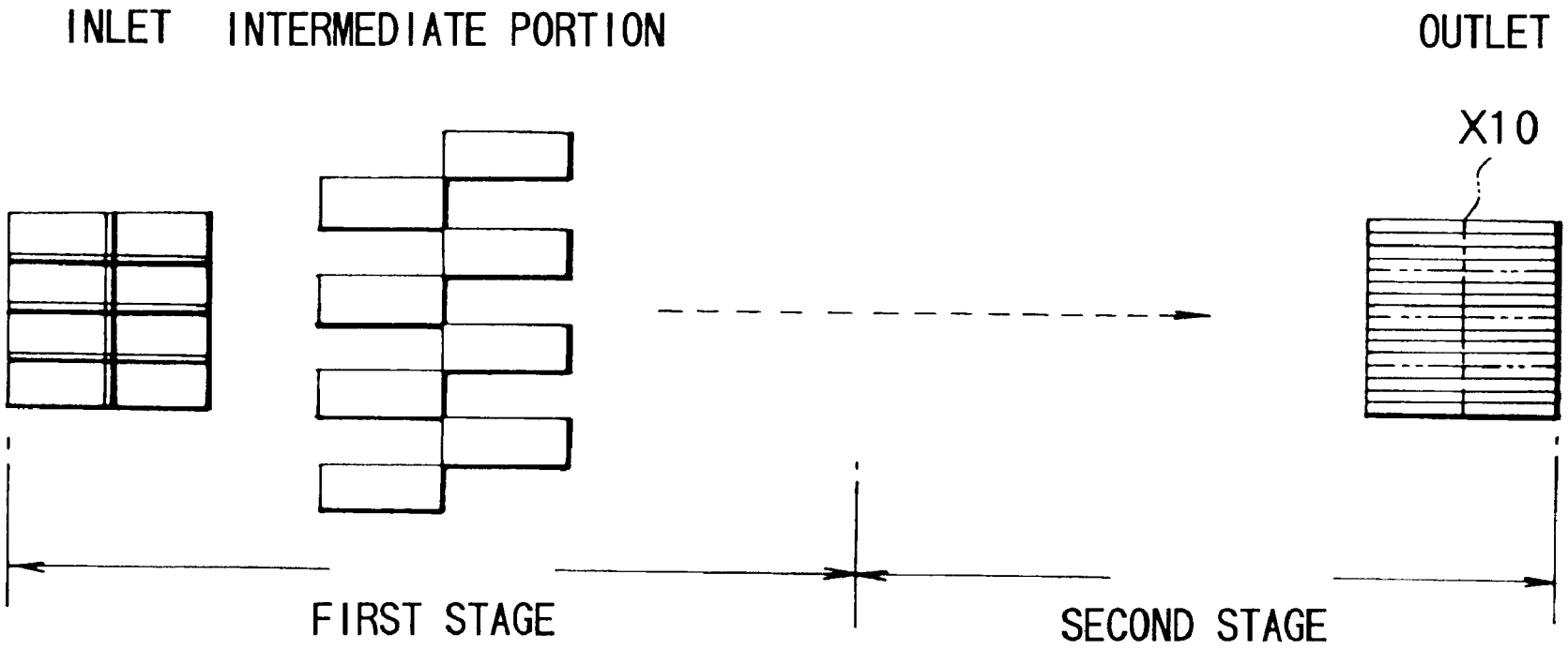
FIG. 25 is a step diagram showing an additional mixing step modelwise by the apparatus body in the mixing apparatus of the present invention.

FIG. 25 similarly shows an example corresponding to the element including eight irregular passageways. In this case, the bore at the inlet-side edge portion of each element is partitioned so that crosswise elongate rectangular inlets of the respective irregular passageways are arranged crosswise by twos at four stage lengthwise. Then, the bore at the outlet-side edge portion of each element is partitioned so that the crosswise elongate rectangular outlets of the respective irregular passageways are arranged lengthwise in the side-by-side relationship. Accordingly, the mixed materials extruded out of the second-stage outlet-side edge portion are arranged in 16 layers each assuming the crosswise elongate rectangular shape in section. Herein, an imaginary line X10 indicates the third-stage dividing line.

Figure 26:
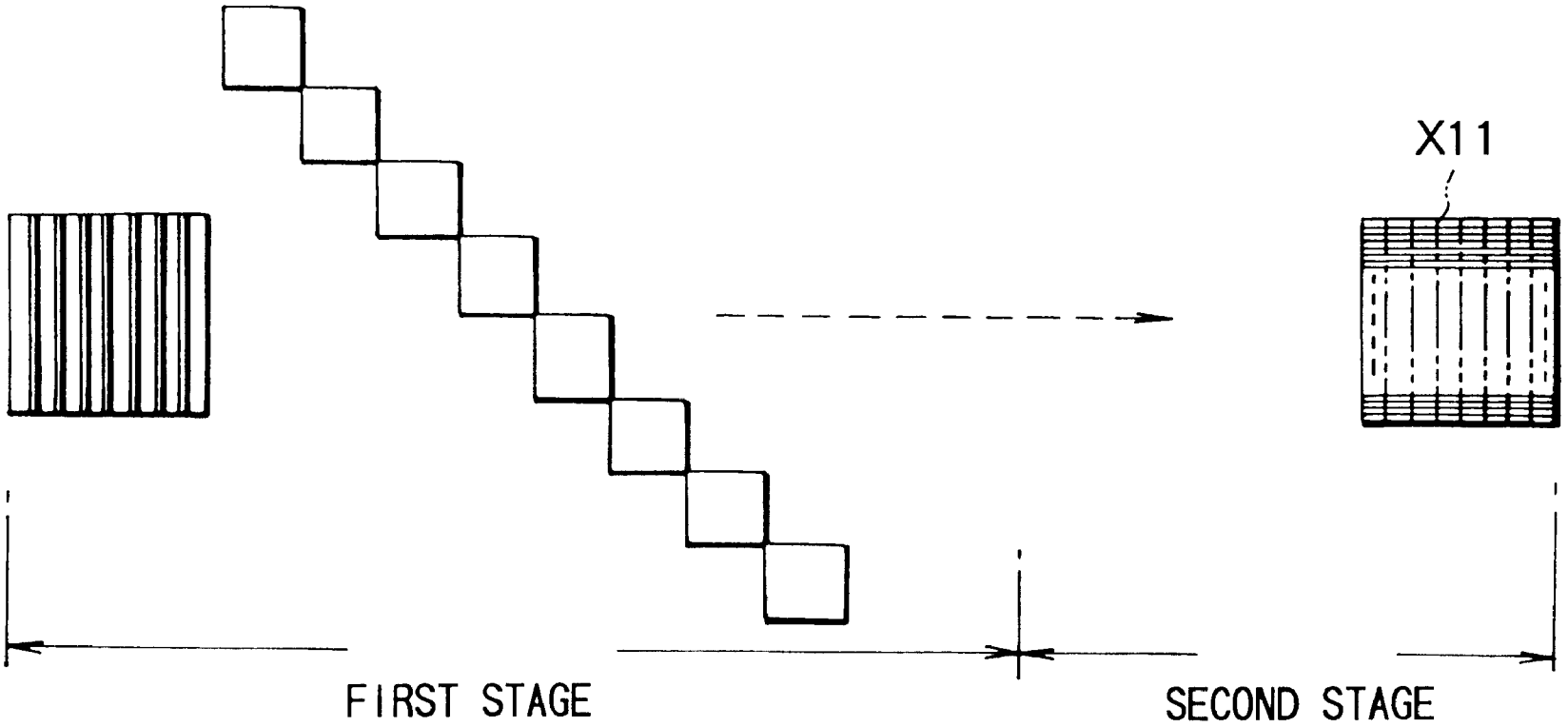
FIG. 26 is a step diagram showing a yet additional mixing step by the apparatus body in the mixing apparatus of the present invention.

FIG. 26 likewise illustrates an example corresponding to the element including eight irregular passageways. In this case, the bore at the inlet-side edge portion of each element is partitioned so that eight pieces of lengthwise elongate rectangular inlets of the respective irregular passageways are arranged crosswise in the side-by-side relationship. Therefore, the mixed materials extruded out of the second-stage outlet-side edge portion are arranged in 64 layers each assuming the crosswise elongate rectangular shape in section. Herein, imaginary lines X11 indicate the third-stage dividing lines.

Further, the unit for connecting the plurality of elements may adopt, in addition to the flange connection system, a one-touch joint system easy to perform operations such as maintenance/inspection, internal cleaning, and decomposition. Note that the embodiments discussed above exemplify the constructions in which the three or five stages of elements are connected, however, as a matter of course, more stages of elements may also be connected as the necessity arises. In this case, a series of joint elements may be so connected as to be curved at the connecting portions, thus taking a meandering form on the whole. If connected in this manner, the designing can be made with a shorter length, correspondingly.

In the mixing apparatus in each embodiment, the plurality of elements having the same construction are connected. However, two kinds of elements each having a different construction may also be alternately connected, or three or more kinds of elements may be so used as to be connected in sequence.

Furthermore, in the mixing apparatus in the embodiments discussed above, the apparatus body is constructed of the plurality of elements connected to each other but may also be manufactured as one united body. Moreover, the mixed materials are applicable to a variety of materials exclusive of the mortar and the concrete on condition that the materials exhibit a proper fluidity.

As can be understood from the embodiments discussed above, in terms of the number of the irregular passageways and the mixing efficiency, the mixing efficiency can be more enhanced with a construction of providing simply lengthwise or crosswise partitioning than in the dividing at the upper and lower stages in the case of the elements having the same number of irregular passageways. In such a case, as a matter of course, the mixing efficiency is more improved with a larger number of partitions as well as being outstandingly enhanced in one irregular passageway. The reason for this is that when the mixed material is reshaped in sectional configuration from the lengthwise elongate rectangle to the crosswise elongate rectangle, a fluid range with the reshaping of the mixed material itself becomes bigger as the two rectangles get narrower and more elongate.

Depending on the particle size and the degree of fluidity of the mixed material, however, it is better for the inlet not to be minutely divided in some cases. Further, it is desirable that the number of divisions and the size of sectional area be set corresponding to viscosity and plasticity of the mixed material.

Moreover, the following can be comprehended with respect to the variations in the sectional configuration of the mixed material. The heightwise dimension at the outlet versus the heightwise dimension at the inlet continuously changes at a rate of 1/number-of-partitions. Further, the widthwise dimension at the outlet versus the widthwise dimension at the inlet continuously varies to become a several-fold value as large as the number of partition walls.

As discussed above, according to the mixing method and the mixing apparatus of the present invention, when the mixed materials exhibiting the fluidity are so pressurized as to be fed into the irregular passageways continuously varying in their sectional shape from the inlets towards the outlets, the sectional configurations of the mixed materials consecutively change corresponding to the sectional shapes of the irregular passageways. Therefore, the compacting action and the reshaping action based thereon are given to the mixed materials. It is thereby feasible to mix the materials more efficiently by use of the mechanical apparatus with the comparatively simple structure that has no direct movable units and therefore no necessity for preventing damages and abrasions as well.

Furthermore, according to the mixing method and the mixing apparatus, there is provided the confluent/diverging unit, wherein the plurality of irregular passageways are arranged in the side-by-side relationship, and the mixed materials flowing through the respective irregular passageways are made confluent and diverged between the inlets and the outlets of the irregular passageways. The mixing efficiency thereby gets by far higher.

Moreover, the apparatus body of the mixing apparatus according to the present invention can be constructed by connecting the plurality of elements in series, each element having the irregular passageways. Therefore, the elements can be easily manufactured as well as being resultantly easy to manufacture the mixing apparatus as a whole.

It is apparent that, in this invention, a wide range of different working modes can be formed based on the invention without deviating from the spirit and scope of the invention. This invention is not restricted by its specific working modes except being limited by the appended claims.

What is claimed is:

1. A method of mixing mixed materials having a fluidity, the mixed materials forming concrete and being mixed by running the mixed materials through an element having at least two irregular passageways, each irregular passageway having an inlet, an outlet and continuously varying sectional configurations from the inlet to the outlet, said method comprising:

a step of feeding the mixed materials by compulsory pressurization into the inlets of said irregular passageways; and a step of continuously changing the sectional configurations of the mixed materials corresponding to the sectional shapes of said irregular passageways so that said changing of the sectional configurations of the mixed materials includes a compacting action and a reshaping action that further mixes the mixed materials.

2. A mixing method according to claim 1, further including a step of mixing said mixed materials by running said mixed materials through a plurality of said elements arranged end to end so that outlets on one element abut inlets on an adjacent element, said mixed materials being made confluent by leaving said outlets of said irregular passageways in said one element and being diverged into the inlets of said irregular passageways in said adjacent element.

3. A mixing method according to claim 1 or 2, further comprising:

a step of controlling the confluence including, in at least one selected said element, placing said mixed materials in inlets of said irregular passageways at the same time and running said mixed materials through said irregular passageways, each said irregular passageway having a different length from inlet to outlet so that said mixed materials flow through said respective irregular passageway outlets at different times and become confluent at staggered times.

4. A mixing method according to claim 1, further comprising:

a confluence control step of running said mixed materials through bypasses.

5. A mixing method according to claim 1 or 2, wherein apart of material to be mixed in the above mixed materials is fed by pressurization into at least one of said irregular passageways midway through said irregular passageway.

6. A mixing method according to claim 1 or 2 wherein said step of continuously changing the sectional configurations does not use moving parts.

7. A mixing method according to claim 3, wherein said irregular passageways in said element are arranged so that one selected said irregular passageway is substantially straight and another selected said irregular passageway is substantially bent.

* * * * *